US006170935B1

(12) United States Patent
Wakahara et al.

(10) Patent No.: US 6,170,935 B1
(45) Date of Patent: Jan. 9, 2001

(54) IMAGE FORMING APPARATUS THAT FORMS IMAGE ON A MEDIUM BY JUMPING DEVELOPER

(75) Inventors: Shirou Wakahara, Osaka; Yukihito Nishio, Ikoma-gun; Iwakazu Honda, Kitakatsuragi-gun; Katsumi Adachi, Ikoma-gun, all of (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/016,197

(22) Filed: Jan. 30, 1998

(30) Foreign Application Priority Data

Feb. 21, 1997 (JP) ..... 9-038169

(51) Int. Cl.[7] ..... B41J 2/06
(52) U.S. Cl. ..... 347/55
(58) Field of Search ..... 347/59, 55, 154, 347/103, 123, 111, 159, 127, 128, 17, 141, 120, 151; 399/271, 290, 292, 293, 294, 295

(56) References Cited

U.S. PATENT DOCUMENTS 5,708,464 * 1/1998 Desie ..... 347/55

FOREIGN PATENT DOCUMENTS 4-269563 9/1992 (JP) .
6-286203 10/1994 (JP) .
8-099433 4/1996 (JP) .

* cited by examiner

*Primary Examiner*—John Barlow
*Assistant Examiner*—Raquel Yvette Gordon
(74) *Attorney, Agent, or Firm*—Dike, Bronstein, Roberts & Cushman, LLP; David G. Conlin; William J. Daley, Jr.

(57) ABSTRACT

Formed between an opposing electrode and a toner support by a high voltage applied from a high-voltage power source is an electric field required for the toner carried on the toner support to jump toward the opposing electrode. A shield power source is provided to apply an identical voltage as the surface potential of the toner layer carried on the toner support.

14 Claims, 27 Drawing Sheets

Flowchart at the start of operation

IMAGE FORMING APPARATUS THAT FORMS IMAGE ON A MEDIUM BY JUMPING DEVELOPER

BACKGROUND OF THE INVENTION (1) Field of the Invention

The present invention relates to an image forming apparatus which forms images on the recording medium by causing the developer to jump thereto and can be applied to a printer unit in digital copiers and facsimile machines as well as to digital printers, plotters, etc.

(2) Description of the Prior Art

In recent years, as the image forming means for outputting a visual image on recording medium such as recording paper etc., in response to an image signal, image forming apparatuses have been disclosed in Japanese Patent Application Laid-Open Hei 4 No. 269,563, Japanese Patent Application Laid-Open Hei 6 No. 286,203 and Japanese Patent Application Laid-Open Hei 8 No. 99,433, for example, wherein charged particles are placed in an electric field so that they will jump by electric force to adhere to the recording medium whilst the potential to be applied to the control electrode having a number of passage holes located in the jump passage is being varied, to thereby form a latent image on the recording medium, directly.

In the above prior art, the aforementioned control electrode uses a configuration which has a plurality of electrodes and feeder lines and has an electrode having a function of shielding the electrical influence from the electrodes and feeder line from the toner support, or a configuration in which jumping toner is controlled based on matrix control.

FIG. 1 is a schematic diagram showing main components of a conventional image forming apparatus. This apparatus includes an image forming unit 1 having a toner supplying section 2 and a printing section 3. Toner supplying section 2 in image forming unit 1 is composed of a toner storage tank 20 for storing toner 21 as the developer, a toner support 22 of a cylindrical sleeve for magnetically supporting toner 21, a doctor blade 23 which is provided inside toner storage tank 20 to electrify toner 21 and regulate the thickness of the toner layer carried on the peripheral surface of toner support 22. Doctor blade 23 is placed on the upstream side with respect to the rotational direction of toner support 22.

Toner support 22 rotates in the direction of arrow A in the figure. Instead of supporting toner 21 bymagnetic force, toner support 22 is configured so as to support the toner by electric force or combination of electric and magnetic forces. Toner 21 supported on the peripheral surface of toner support 22 is made to stand up in 'spikes' at the area on the peripheral surface facing control electrode 26.

Printing section 3 in image forming unit 1 includes: an opposing electrode 25 facing the peripheral surface of toner support 22; a high-voltage power source 30 for supplying a high voltage to opposing electrode 25; a control electrode 26 provided between opposing electrode 25 and toner support 22; a charge erasing brush 28; a charging brush 8 for charging a sheet of paper 5; a dielectric belt 24; support members 16*a* and 16*b* for supporting dielectric belt 24; and a cleaner blade 19. Applied between opposing electrode 25 and toner support 22 is a high voltage which produces an electric field needed to make toner 21 carried on toner support 22 jump toward opposing electrode 25.

Control electrode 26 is disposed in parallel to the tangent plane of the surface of opposing electrode 25 and spreads two-dimensionally facing opposing electrode 25, and it has a structure to permit the toner to pass therethrough from toner support 22 to opposing electrode 25. The electric field formed between toner support 22 and opposing electrode 25 varies depending on the potential being applied to control electrode 26, so that the jumping of toner 21 from toner support 22 to opposing electrode 25 is controlled.

Control electrode 26 is composed of an insulative board 26*a*, a high voltage driver (not shown), independent annular conductors, i.e., annular electrodes 27 and a shield electrode 39. Board 26*a* has holes forming gates 29, to be mentioned later, formed therein. Annular electrodes 27 are formed of copper foil, for instance, and are arranged around the individual holes in a predetermined layout. Each opening of the annular electrode forms a passage for toner 21 to jump from toner support 22 to opposing electrode 25. Hereinbelow, this passage will be termed gate 29. Shield electrode 39 is also formed of copper foil with an insulative layer 26*b* on the surface thereof, and is disposed on the toner support 22 side with respect to insulative board 26*a*. Configurations having such a shield electrode are disclosed in Japanese Patent Application Laid-Open Hei 4 No. 269,563 and Japanese Patent Application Laid-Open Hei 6 No. 286,203. Japanese Patent Application Laid-Open Hei 8 No. 99,433 disclosed a configuration in which jumping of toner is controlled by the control electrode which is driven by matrix control.

The aforementioned shield electrode 39 is provided to prevent toner 21 adhering to control electrode 26. Unless control electrode 26 has this shield electrode 39, it is impossible to avoid adherence of toner 21 to control electrode 26. If adherence of toner 21 to control electrode 26 occurs, the following defects arise.

In order to illustrate this situation, a control 26 without any shield electrode 39 is illustrated in FIG. 2, which is a sectional view of a control electrode having no shield electrode. First, a voltage which inhibits toner 21 from jumping (to be referred to hereinbelow as the OFF potential) is supplied to annular electrodes 27. In this state, when toner 21 is made to jump to gates 29, a voltage which causes toner 21 to jump (to be referred to hereinbelow as the ON potential) is applied to make toner 21 jump. In this case, as shown in FIG. 3, toner 21 jumps; some toner 21*a* passes through gates 29, other toner 21*b* jumps to areas other than gates 29, i.e., toward the surface of control electrode 26.

Normally, this toner 21*b* will return to toner support 22 when annular electrodes 27 are set at the OFF potential, but some of it, i.e., toner 21*c* as shown in FIG. 4 remains adhering to the control electrode 26. If toner 21*c* adheres to control electrode 26, the apparent potential of control electrode 26 relative to that of toner 21 on toner support 22 varies due to the charge on toner 21*c*. Illustratively, the potential of control electrode 26 tends to vary in such a way as to become close to the voltage for inhibiting toner 21 from jumping, thus making it difficult for the toner to jump. Further, even if a voltage for causing the toner to jump is applied to control electrode 26, toner 21 on toner support 22 does not receive attraction from the electric field for jumping and the desired transfer of toner will not occur. In this case, the resulting image will not have correct density, presenting a dim, blurred state without contrast. In this condition, a desired reproduction of halftones cannot be obtained, making it difficult to form a correct image. Further, in the case of a color image forming apparatus, proper reproduction of colors cannot be obtained because proper amounts of toners cannot transfer.

Furthermore, if the situation of the toner adherence to control electrode 26 becomes worse, the toner jumping becomes more difficult, and finally in the worst case no toner will jump. This causes image defects and difficulty in reproducing color images in the case of a color image forming apparatus.

Besides, if adhering toner 21*c* has adhered to the gate interior, the gate will become clogged as toner 21*c* builds up, causing physical difficulty in toner jumping. In this state, no dots can be formed causing printing deficiency and/or image defects.

As above, adherence of toner 21*c* at the gates and their vicinity, directly causes the above deficiencies. On the other hand, if toner 21 adheres to the areas other than gates 29, the following defects occur. As shown in FIG. 4, toner 21*c* adheres to areas other than the gates, building up as adhering toner 21*d* as shown in FIG. 5. Illustratively, under the condition where some toner remains adhering to control electrode 26, when the voltage for causing toner 21 jump is applied to control electrode 26, toner 21 that has been newly supplied to toner support 22 facing gates 29, jumps therefrom against already adhering toner 21*d* or its vicinity, possibly touching adhering toner 21*d* or colliding against it. At that moment, if the cohesion between the toner particles is very strong, the toner particles form an aggregation, clumping and remaining on control electrode 26. Similarly, as toner 21 repeatedly transfers and adheres to the toner aggregations staying on control electrode 26, the aggregations finally build up covering gates 29 as shown in FIG. 6. In this case, the gates are clogged in the same manner as above causing the same deficiencies. A further buildup of adhering toner 21*d* reaching the layer of toner 21 carried on toner support 22 as shown toner 21*e* in FIG. 6, destroys the layer of toner 21.

This not only makes it difficult to control transfer of the toner to the gate 29 which is located downstream of toner 21*e* but also induces toner clog of the other gates 29.

These deficiencies occur as a result of transfer of toner 21 from areas other than that facing gates 29 to control electrode 26 when the ON potential is applied to the annular electrodes 27. Therefore, it is preferable that, at least, no electric field for jumping should be created in areas other than those facing gates 29. The simplest way of achieving this is a provision of an electrode plate as shield electrode 39 on control electrode 26 between annular electrodes 27 and toner support 22. In this arrangement, when shield electrode 39 is applied with a voltage which is opposite to the polarity of the toner or at least produces an electric field which is able to revert the toner back to toner support 22, in theory no toner will transfer to the areas other than gates 29 and their vicinity on control electrode 26. In case that some toner transfers to the periphery of gates 29, the electric field between shield electrode 39 and toner support 22 reverts the toner back to toner support 22, thus no aforementioned deficiency will occur.

However, the practical situation is that, even if shield electrode 39 is provided and is applied with a voltage of like polarity to the toner, adherence of toner can be improved to some degree, but not to a perfect level. Eventually, at some point, some kind of the aforementioned toner clog will occur, causing the above deficiencies.

One of the reasons is that there is some of toner 21 which has the opposite charge-characteristics (to be referred to as opposite charged toner) to that of the desired charge. When shield electrode 39 has a voltage of the same polarity as that of toner 21 applied so as to create an electric field which reverts the toner back to the toner support, the toner having normal charge-characteristics, as intended, will not jump and adhere to shield electrode 39. However, some toner having the opposite charge existing in the layer of toner 21 still jumps toward shield electrode 39 and adheres to shield electrode 39. This opposite charged toner is, in general, present at some percentage and is very little, but it will resultantly transfer and adhere to shield electrode 39 after a prolonged period of the image forming operation or other causes. Thus, this opposite charged toner will gradually build up with the passage of time, finally growing into toner aggregations like adhering toner 21*d* and 21*e* as stated above and consequently causing printing deficiencies and toner clog in gates 29 as stated above.

It is very difficult to produce toner absolutely free from opposite charged toner as long as normal toner is used. Even through a toner which is completely free from oppositely charged toner can be produced, its price will be extremely high, resulting in practical difficulties. Accordingly, the configuration in which toner 21 is placed in a neutral electric field is the most preferable. In the prior art disclosed in Japanese Patent Application Laid-Open Hei 4 No. 269,563, a reference electrode having the voltage applied to the sleeve (toner support) is used as the shield electrode (see FIG. 1).

However, in practice, the charge carried on toner 21 has a potential relative to sleeve 22, the surface potential of toner 21 supported on sleeve 22 has a potential of a like polarity to that of toner 21. This creates a potential difference between shield electrode 39 and the toner layer surface, forming an electric field, so that toner 21 on the sleeve, in particular the topmost surface of toner 21 is electrically attracted toward the shield electrode. This electric field is trivial. Nevertheless, even in this case toner will not be completely stopped from jumping by the electric field, resultantly a trace amount of toner will jump to shield electrode 39. In the case where a prolonged period of printing is repeatedly performed under this condition, the trace amount of toner 21 jumping by the electric field builds up, resultantly forming aggregations of toner 21 such as adhering toner 21*d* or 21*e*, thus causing toner clog in gates 29 and inducing printing deficiencies.

Further, in the case where the control electrode of the above prior art is used, the potential required for controlling the jump of toner 21 tends to become higher because annular electrode group 27 to which the voltage for controlling the toner jumping is applied is located more distant from toner support 22 than shield electrode 39. In general, the closer to toner support 22 electrode group 27 is located, the lower is the potential. As a result, the withstanding voltage of the transistors etc. used in the voltage switching means can be reduced further, facilitating the reduction of the cost of the switching circuit. In the above prior art, however, because of its configuration requirements, it is impossible to arrange annular electrode group 27 and shield electrode 39 on the same plane; this means that a higher voltage than that minimally required for controlling the toner jumping is needed, making it difficult to reduce the cost relating to the voltage switching means.

In a type of image forming apparatus of the above prior art, since the amount of toner that jumps is controlled by the electric field formed between gate 29 and toner support 22, the amount of toner that jumps will differ if the electric field is different. In the prior art stated above where toner support 22 of a cylindrical sleeve and control electrode 26 having a two-dimensional gate array are used, the distance between toner support 22 and control electrode 26 is not uniform due to the curvature of the sleeve. At the side areas of support 22, its distance from the control electrode is greater than from the central portion. Accordingly, the electric field at areas to the side is weak, so that the amount of toner passing through gates 29 and the track of the passage of toner are not uniform, resulting in dots thin in contrast at areas to the side and thick dots at the central area. As countermeasures against this, some techniques have been used such as increasing the voltage to be applied to the electrode at areas to the side when toner passes through.

However, the configuration in which the voltage for controlling the toner jumping is adjusted not only needs an increased number of power sources but, also needs extra high withstanding voltage FETs if the potential difference exceeds the nominal withstanding voltage of the current FETs used for the voltage switching means. This necessitates high withstanding voltage insulation for the circuits and increase in the cost of the FETs, needing more parts and unavoidably resulting in increase in size and cost of the apparatus. If the toner control of jumping is performed without increasing the withstanding voltage of FETs, the following deficiencies occur.

If the control voltage for toner jumping is increased without increasing the withstanding voltage of FETs, either the potential to be applied for making the toner jump (to be referred to hereinbelow as the ON potential) or the potential to be applied for prohibiting the toner from jumping (to be referred to hereinbelow as OFF potential) must be lowered. If the OFF potential is increased, the ON potential must be decreased, resulting in insufficiency of toner transfer and hence producing a blurred image without contrast. On the other hand, the ON potential is set higher, the OFF potential must be reduced. In this case, the stoppage of toner jumping cannot be correctly achieved, causing background fogginess, producing an image without contrast and thus making it difficult to achieve a satisfactory image forming operation. In the case of a color image forming apparatus, desired toner jumping cannot be obtained causing image degradation with insufficient reproduction of colors.

To deal with this, an attempt for varying the size of the electrode has been attained as in Japanese Patent Application Laid-Open Hei 8 No. 99,433. In this conventional art, the toner supported on the toner support jumps to areas other than the gates on the other electrode of the control electrode. Most of the toner having transferred to the control electrode will return to the toner support when the potential of the control electrode is switched. However, there is some toner which stays on the control electrode as already stated, and the remaining toner causes the apparent voltage of the control electrode to vary, resulting in insufficiency of toner jumping. With a further increase of the toner adherence, the toner will finally cover the gates and build up to destroy the toner layer carried on the surface of the toner support.

SUMMARY OF THE INVENTION

It is therefore an object of the present invention to provide an image forming apparatus which can achieve excellent image forming by preventing adherence of the developer to the control electrode and suppressing the variation in the jumping amount of the developer passing through different gates of the control electrode.

In order to achieve the above object, the present invention is configured as follows:

In accordance with the first aspect of the invention, an image forming apparatus includes:

a supporting means for supporting the developer;

an opposing electrode disposed facing the supporting means;

a control electrode wherein a plurality of gates which form passage for the developer, a plurality of gate electrodes each located around a gate and a shield electrode having openings which each corresponds to a gate electrode and allow at least part of the gate electrode to be directly or electrically exposed to the supporting means are provided on an insulative board disposed between the supporting means and the opposing electrode; and a controlling means which applies a predetermined voltage to each of the electrodes on the control electrode at least in accordance with the image data, wherein the controlling means controls passage of gates for the developer by applying the predetermined potential to the gate electrodes so as to form an image on a recording medium as it is being conveyed between the control electrode and the opposing electrode, and is characterized in that the controlling means applies a voltage equal or approximately equal to the surface potential of the developer when it is carried on the supporting means, at least to the shield electrode.

Next, in accordance with the second aspect of the invention, an image forming apparatus includes:

a supporting means for supporting the developer;

an opposing electrode disposed facing the supporting means;

a control electrode wherein a plurality of gates which form passage for the developer, a plurality of gate electrodes each located around a gate and a shield electrode having openings which each corresponds to a gate electrode and allow at least part of the gate electrode to be directly or electrically exposed to the supporting means are provided on an insulative board disposed between the supporting means and the opposing electrode; and a controlling means which applies a predetermined voltage to each of the electrodes on the control electrode at least in accordance with the image data, wherein the controlling means controls passage of gates for the developer by applying the predetermined potential to the gate electrodes so as to form an image on a recording medium as it is being conveyed between the control electrode and the opposing electrode, and is characterized in that as the voltage to be applied to a gate electrode when the developer is prohibited from passing at least through the gate, the controlling means applies a voltage equal or approximately equal to the surface potential of the developer when it is carried on the supporting means, to the gate electrode.

In accordance with the third aspect of the invention, an image forming apparatus includes:

a supporting means for supporting the developer;

an opposing electrode disposed facing the supporting means;

a control electrode wherein a plurality of gates which form passage for the developer, a plurality of gate electrodes each located around a gate and a shield electrode having openings which each corresponds to a gate electrode and allow at least part of the gate electrode to be directly or electrically exposed to the supporting means are provided on an insulative board disposed between the supporting means and the opposing electrode; and a controlling means which applies a predetermined voltage to each of the electrodes on the control electrode at least in accordance with the image data, wherein the controlling means controls passage of gates for the developer by applying the predetermined potential to the gate electrodes so as to form an image on a recording medium as it is being conveyed between the control electrode and the opposing electrode, and is characterized in that the controlling means further has a detecting means for detecting the surface potential of the developer carried on the supporting means, and can apply the voltage equal to the surface potential of the developer carried on the supporting means, detected by the detecting means, to at least one of the electrodes.

In accordance with the fourth aspect of the invention, an image forming apparatus comprising:

a supporting means for supporting the developer;

an opposing electrode disposed facing the supporting means;

a control electrode wherein a plurality of gates which form passage for the developer, a plurality of gate electrodes each located around a gate and a shield electrode having openings which each corresponds to a gate electrode and allow at least part of the gate electrode to be directly or electrically exposed to the supporting means are provided on an insulative board disposed between the supporting means and the opposing electrode; and a controlling means which applies a predetermined voltage to each of the electrodes on the control electrode at least in accordance with the image data, wherein the controlling means controls passage of gates for the developer by applying the predetermined potential to the gate electrodes so as to form an image on a recording medium as it is being conveyed between the control electrode and the opposing electrode, and is characterized in that the shield electrode and the gates electrodes provided in the control electrode are arranged on an identical plane thereof, and feeder elements connecting the gate electrodes to the control means are provided on the side opposite to the supporting means with respect to the shield electrode.

In accordance with the fifth aspect of the invention, an image forming apparatus includes:

a supporting means for supporting the developer;

an opposing electrode disposed facing the supporting means;

a control electrode wherein a plurality of gates which form passage for the developer, a plurality of gate electrodes each located around a gate and a shield electrode having openings which each corresponds to a gate electrode and allow at least part of the gate electrode to be directly or electrically exposed to the supporting means are provided on an insulative board disposed between the supporting means and the opposing electrode; and a controlling means which applies a predetermined voltage to each of the electrodes on the control electrode at least in accordance with the image data, wherein the controlling means controls passage of gates for the developer by applying the predetermined potential to the gate electrodes so as to form an image on a recording medium as it is being conveyed between the control electrode and the opposing electrode, and is characterized in that the degree of exposure including electrical exposure of each gate electrode to the developer carried on the supporting means is controlled by the shield electrode.

In accordance with the sixth aspect of the invention, the image forming apparatus having the above fifth feature is characterized in that the degree of exposure is controlled by the positional relationship, and/or the relative potential difference, of the shield electrode relative to supporting means and the gate electrode.

In accordance with the seventh aspect of the invention, the image forming apparatus having the above fifth feature is characterized in that the degree of exposure is adapted to vary for each of the gate electrodes.

In accordance with the eighth aspect of the invention, the image forming apparatus having the above seventh feature is characterized in that the variation of the degree of exposure is controlled by the distance between the gate and the developer or depending upon the strength of the electric field formed by the control electrode.

In accordance with the ninth aspect of the invention, the image forming apparatus having the above seventh feature is characterized in that the variation of the degree of exposure is controlled by the ratio between the size of the gate electrode and the diameter of the opening formed in the shield electrode.

In accordance with the tenth aspect of the invention, the image forming apparatus having the above fifth feature further includes a detecting means for detecting the characteristics of the developer or the characteristic value of the developer when it is supported on the supporting means, wherein the controlling means controls the degree of exposure based on the detected value of the detecting means.

In accordance with the eleventh aspect of the invention, the image forming apparatus having the above sixth feature further includes a detecting means for detecting the characteristics of the developer or the characteristic value of the developer when it is supported on the supporting means, wherein the controlling means controls the degree of exposure based on the detected value of the detecting means.

In accordance with the twelfth aspect of the invention, the image forming apparatus having the above seventh feature further includes a detecting means for detecting the characteristics of the developer or the characteristic value of the developer when it is supported on the supporting means, wherein the controlling means controls the degree of exposure based on the detected value of the detecting means.

In accordance with the thirteenth aspect of the invention, the image forming apparatus having the above eighth feature further includes a detecting means for detecting the characteristics of the developer or the characteristic value of the developer when it is supported on the supporting means, wherein the controlling means controls the degree of exposure based on the detected value of the detecting means.

In accordance with the fourteenth aspect of the invention, the image forming apparatus having the above ninth feature further includes a detecting means for detecting the characteristics of the developer or the characteristic value of the developer when it is supported on the supporting means, wherein the controlling means controls the degree of exposure based on the detected value of the detecting means.

As stated above, in the above first through third configuration of the invention, since the same voltage as the surface potential of the toner layer carried on the toner support is applied to shield electrode and the gates when they are set at the OFF potential, no potential difference and hence no electric field will be generated between the toner layer and the control electrode. In this way, regardless of the polarity of the static charge on the toner, no toner will transfer to the shield electrode, and hence no toner will adhere to the shield electrode.

In the above fourth configuration of the invention, the shield electrode and the gate electrodes to which the voltage for controlling toner jumping is applied are arranged on the same plane. This arrangement enables the gate electrodes to be positioned closer to the toner support, thus making it possible to reduce the control voltage. Accordingly, the withstanding voltage of the potential switching means to be used for this function can be reduced and hence the circuit cost.

In accordance with the above fifth through fourteenth configurations, the degree of exposure (including the degree of electrical exposure) of the gate electrodes to the toner support or the toner carried on the toner support is adjusted by the shield electrode or the gate electrodes. Accordingly, a desired amount of jumping toner can be obtained easily.

Thus, the image forming apparatus of the invention can achieve excellent image forming.

DESCRIPTION OF THE PREFERRED EMBODIMENTS

The embodiment of the invention will hereinafter be described with reference to the accompanying drawings.

Figure 1:
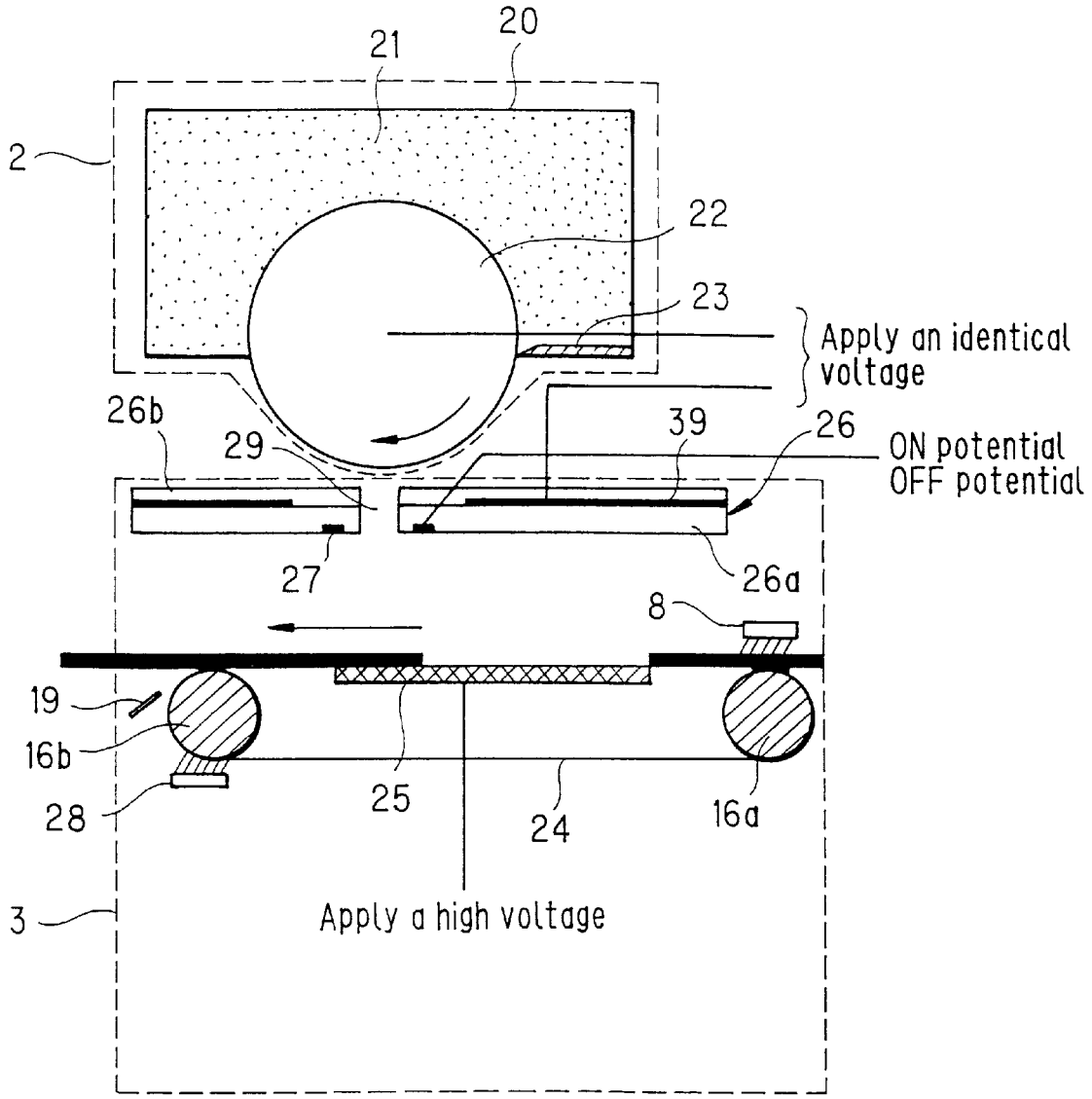
FIG. 1 PRIOR ART
FIG. 1 is a schematic diagram showing essential components of a conventional image forming apparatus.
Figure 2:
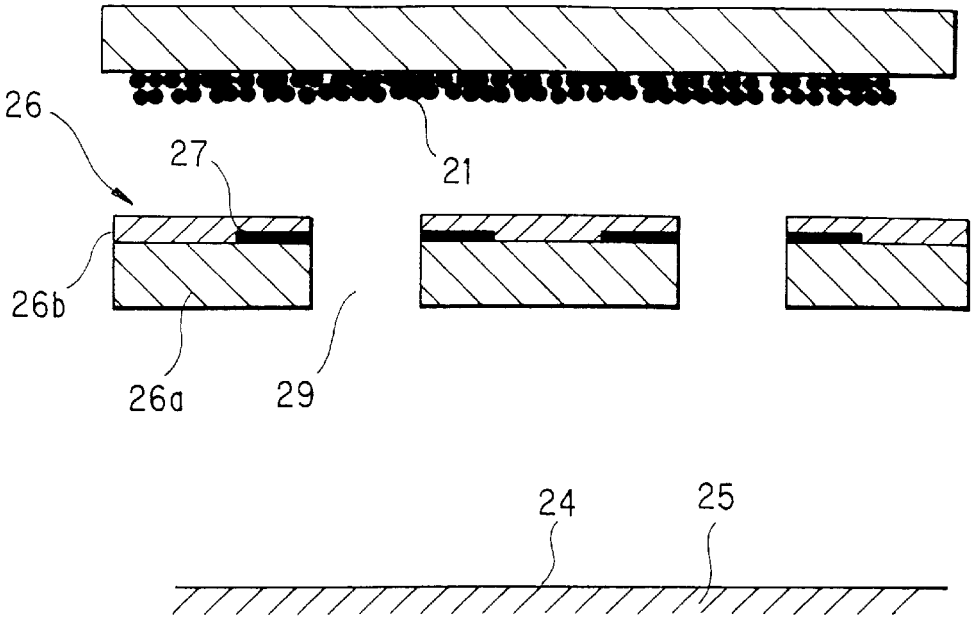
FIG. 2 PRIOR ART
FIG. 2 is a sectional view showing essential components relating to the process of toner jumping in a conventional image forming apparatus.
Figure 3:
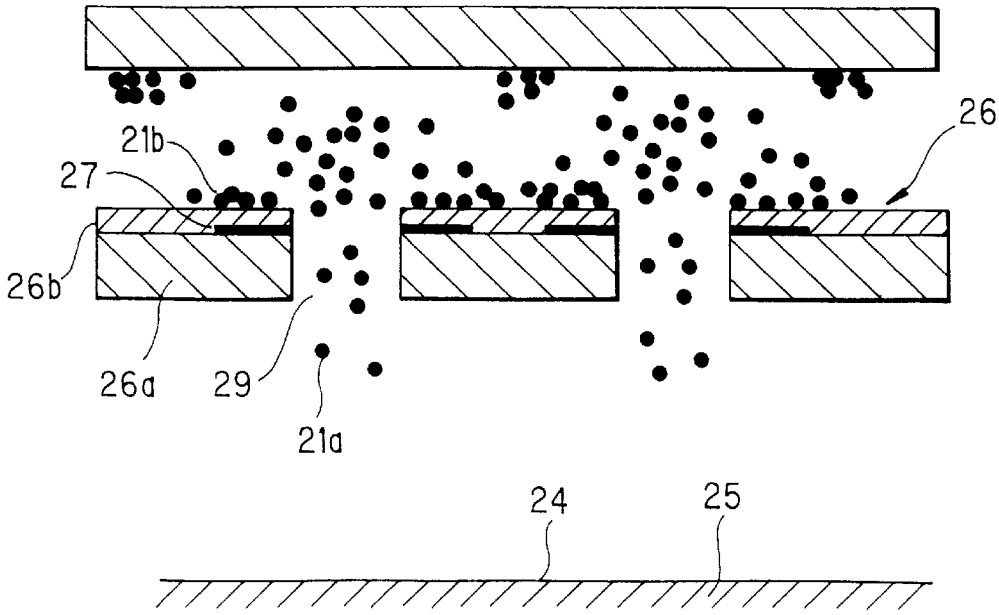
FIG. 3 PRIOR ART
FIG. 3 is an illustrative diagram showing toner jumping in the part of the machine of FIG. 2.
Figure 4:
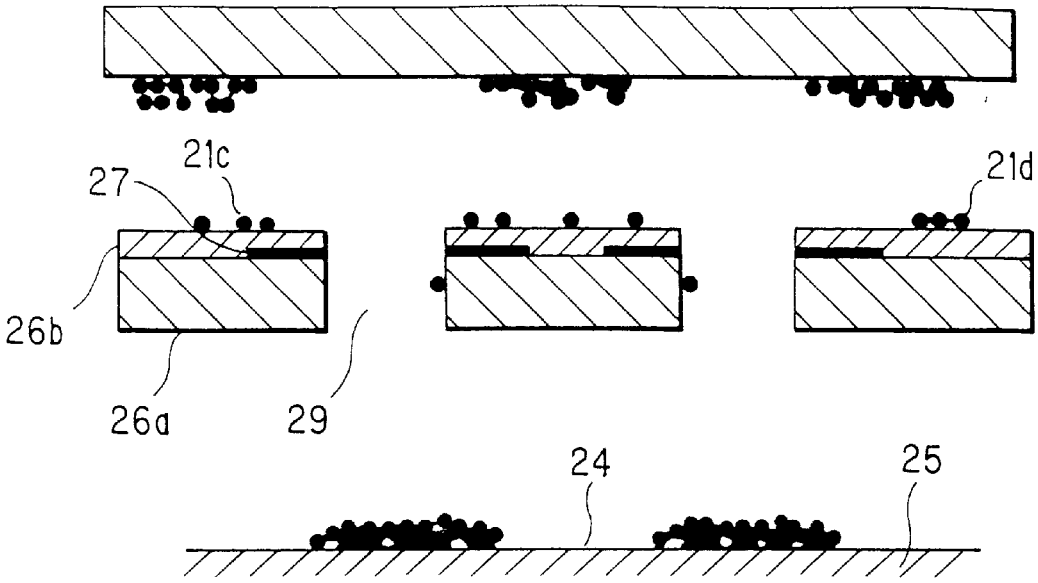
FIG. 4 PRIOR ART
FIG. 4 is an illustrative diagram showing toner jumping in the part of the machine of FIG. 2.
Figure 5:
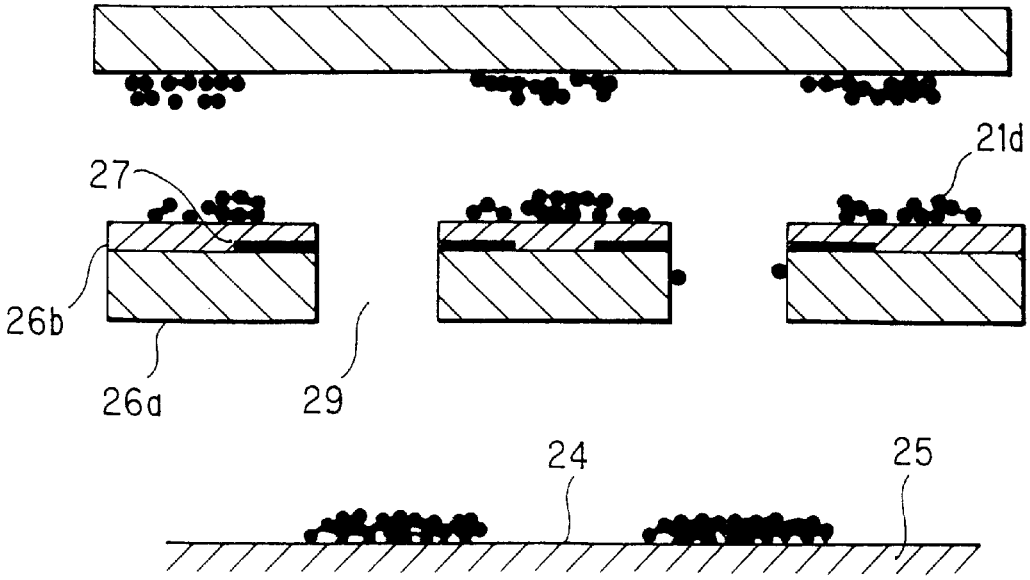
FIG. 5 PRIOR ART
FIG. 5 is an illustrative diagram showing toner jumping in the part of the machine of FIG. 2.
Figure 6:
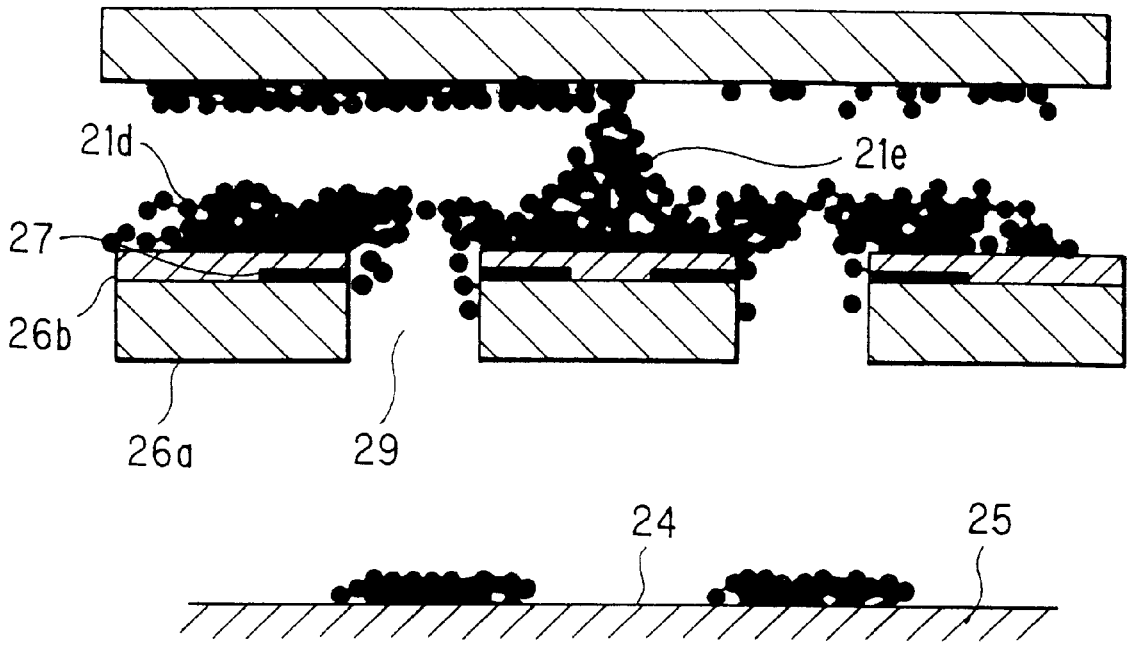
FIG. 6 PRIOR ART
FIG. 6 is an illustrative diagram showing toner jumping in the part of the machine of FIG. 2.
Figure 7:
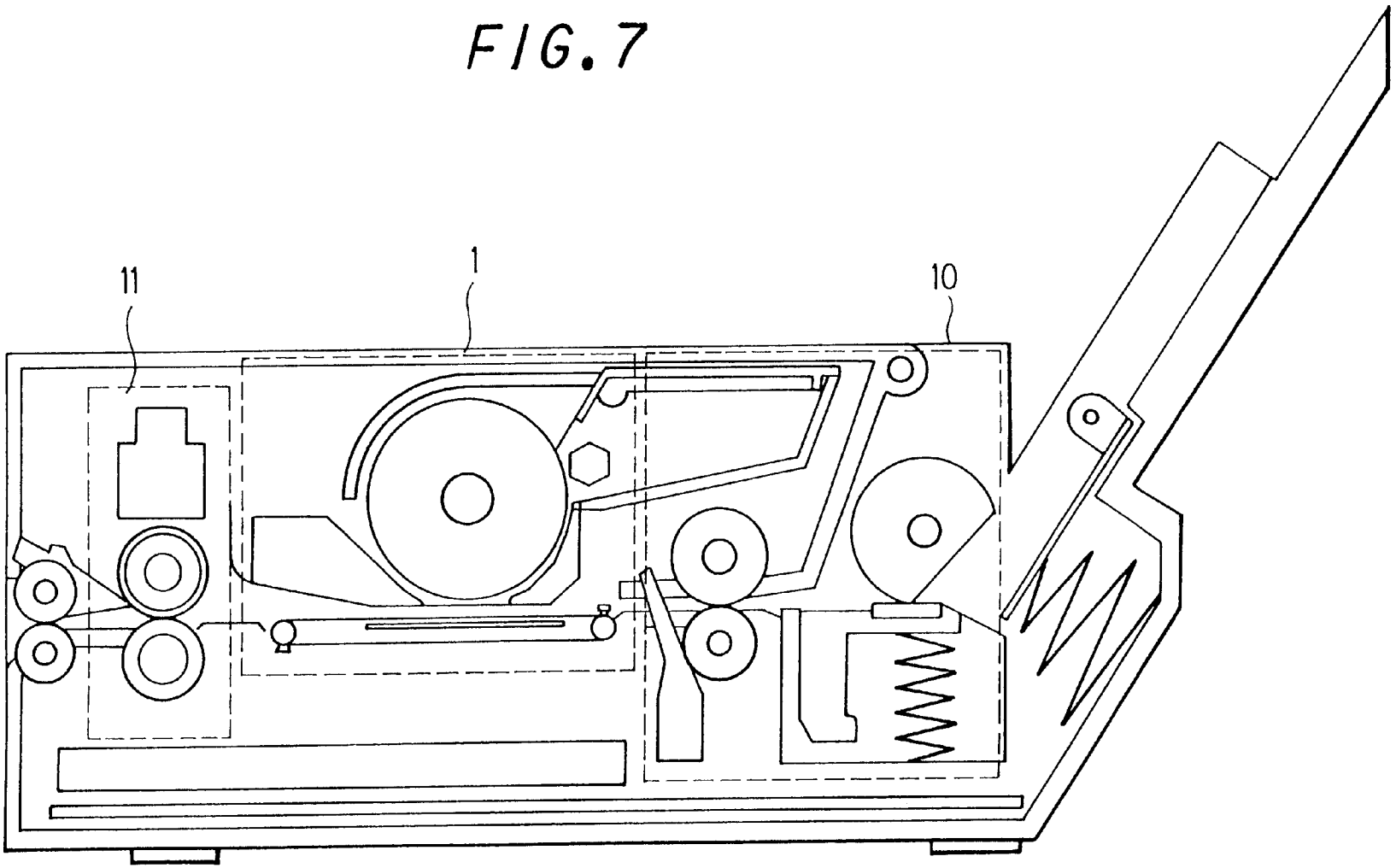
FIG. 7 is a schematic sectional view showing the overall configuration of an image forming apparatus in accordance with the present invention.
Figure 8:
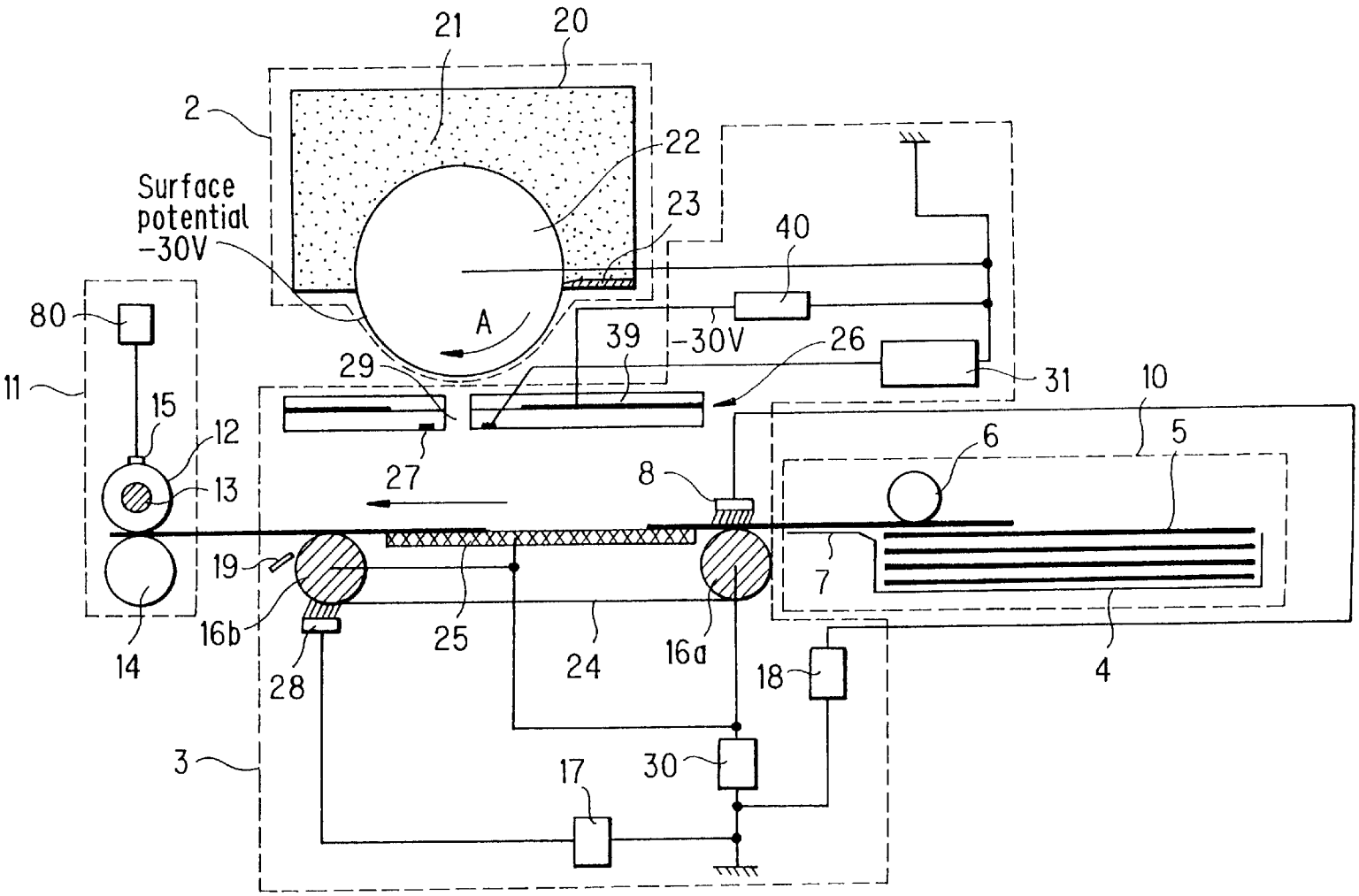
FIG. 8 is a schematic configurational diagram showing essential components of the image forming apparatus.

FIG. 7 is a schematic sectional view showing the overall configuration of an image forming apparatus in accordance with the present invention. FIG. 8 is a schematic configurational diagram showing essential components of this image forming apparatus. In the following description, the image forming apparatus with a configuration for negatively charged toner will be described, but the polarity of each voltage to be applied may be appropriately set if positive charged toner is used.

(Configuration of the Apparatus)

This image forming apparatus has almost the same configuration as has been described in the conventional art, and has an image forming unit 1 which is composed of a toner supplying section 2 and a printing section 3. Image forming unit 1 creates a visual image in accordance with an image signal, onto a sheet of paper as recording medium with toner as the developer. In this image forming apparatus, the toner is selectively made to jump and adhere onto the paper whilst the jumping of the toner is controlled based on the image forming signal so as to directly create an image on the paper.

A paper feeder 10 is provided on the input side of image forming apparatus 1 to which the paper is fed. Paper feeder 10 is composed of a paper cassette 4 for storing paper 5 as recording medium, a pickup roller 6 for delivering paper 5 sheet by sheet from paper cassette 4, and a paper guide 7 for guiding fed paper 5. Paper feeder 10 further has unillustrated detecting sensors for detecting the feed of paper 5. Pickup roller 6 is rotationally driven by an unillustrated driving means.

Provided on the output side of image forming apparatus 1 from which the paper is output, is a fixing unit 11 for heating and pressing the toner image which was formed on paper 5 at the image forming unit 1, to fix it onto paper 5. Fixing unit 11 is composed of a heat roller 12, a heater 13, a pressing roller 14, a temperature sensor 15, and a temperature controller circuit 80. Heat roller 12 is made up of, for example, an aluminum pipe of 2 mm thick. Heater 13 is a halogen lamp, for example, which is incorporated in heat roller 12. Pressing roller 14 is made of e.g., silicone resin. Heat roller 12 and pressing roller 14 which are arranged opposite to each other, are pressed against one another in order to hold paper 5 in between and press it, with a pressing load, e.g. 2 kg, from unillustrated springs etc., provided at both ends of their shafts. Temperature sensor 15 measures the surface temperature of heat roller 12. Temperature controller circuit 80 is controlled by a main controller which performs the on/off operation of heater 13 and other control based on the measurement of temperature sensor 15, thus maintaining the surface temperature of heater roller 12 at, for example, 150° C. Fixing unit 11 has an unillustrated paper discharge sensor for detecting the discharge of paper 5.

The materials of heat roller 12, heater 13, pressing roller 14, etc., are not specifically limited. The surface temperature of heat roller 12 also is not specifically limited. Further, fixing unit 11 may use a fixing configuration in which paper 5 is heated or pressed to fix the toner image.

Further, although it is not shown in the drawing, the paper output side of fixing unit 11 has a paper discharge roller for discharging paper 5 processed through fixing unit 11 onto a paper output tray and a paper output tray for holding paper 5 thus discharged. The aforementioned heat roller 12, pressing roller 14 and paper discharge roller are rotated by an unillustrated driving means.

Toner supplying section 2 in image forming unit 1 is composed of a toner storage tank 20 for storing toner 21 as the developer, a toner support 22 of a cylindrical sleeve for magnetically supporting toner 21 and a doctor blade 23 which is provided inside toner storage tank 20 to electrify toner 21 and regulate the thickness of the toner layer carried on the peripheral surface of toner support 22. Doctor blade 23 is arranged on the upstream side of toner support 22 with respect to the rotational direction, spaced with a distance of about 60 $\mu$m, for example, from the peripheral surface of toner support 22. Toner 21 is of a magnetic type having a mean particle diameter of, for example, 6 $\mu$m, and is electrified with static charge of $-4$ $\mu$C/g to $-5$ $\mu$C/g by doctor blade 23. Here, the distance between doctor blade 23 and toner support 22 is not particularly limited. Also the mean particle size, the amount of static charge, etc., of toner 21 are not particularly limited, Toner support 22 is rotationally driven by an unillustrated driving means in the direction indicated by arrow A in the figure, with its surface speed set at 80 mm/sec, for example. Toner support 22 is grounded and has unillustrated magnets arranged therein, at the position opposite doctor blade 23 and at the position opposite a control electrode 26 (which will be described later). This arrangement permits toner support 22 to carry toner 21 on its peripheral surface. Toner 21 supported on the peripheral surface of toner support 22 is made to stand up in 'spikes' at the areas on the peripheral surface corresponding the positions of aforementioned magnets. Rotating speed of toner support 22 is not particularly limited. Here, the toner is supported by magnetic force, but toner support 22 can be configured so as to support toner 21 by electric force or combination of electric and magnetic forces.

Printing section 3 in image forming apparatus 1 includes: an opposing electrode 25 which is made up of an aluminum sheet of, for example, 1 mm in thick and faces the peripheral surface of toner support 22; a high-voltage power source 30 for supplying a high voltage to opposing electrode 25; control electrode 26 provided between opposing electrode 25 and toner support 22 for controlling toner jumping; a charge erasing brush 28; a charge erasing power source 17 for applying a charge erasing voltage to charge erasing brush 28; a charging brush 8 for charging sheet 5; a charger power source 18 for supplying a charger voltage to charging brush 8; a dielectric belt 24; support rollers **16*a* and 16*b* for supporting dielectric belt 24; and a cleaner blade 19**.

Opposing electrode 25 is arranged e.g., 1.1 mm apart from the peripheral surface of toner support 22. Dielectric belt 24 is made of poly(vinylidene fluoride) (PVDF) as a base material, and is 75 $\mu$m thick with a volume resistivity of $10^{10}$ $\Omega$·cm. Dielectric belt 24 is rotated by an unillustrated driving means in the direction of the arrow in the drawing, at a surface speed of 30 mm/sec. Applied to opposing electrode 25 is a high voltage, e.g., 2.3 kV from high voltage power source (controlling means) 30. This high voltage supplied from high voltage power source 30 generates an electric field between opposing electrode 25 and toner support 22, required for causing toner 21 being supported on toner support 22 to jump toward opposing electrode 25.

Charge erasing brush 28 is pressed against dielectric belt 24 at a position downstream, relative to the rotational direction of dielectric belt 24, and of control electrode 26. Charge erasing brush 28 has an erasing potential of 2.5 kV applied from charge erasing power source 17 so as to eliminate unnecessary charges on the surface of dielectric belt 24.

If some toner 21 adhered to the surface of dielectric belt 24 due to a contingency such as paper jam, etc., cleaning blade 19 removes this toner 21 to prevent staining by toner 21 on the paper underside. The material of opposing electrode 25 is not particularly limited. The distance between opposing electrode 25 and toner support 22 is not particularly specified either. Further, the rotational speed of opposing electrode 25 or the voltage to be applied thereto is not particularly limited either.

Although unillustrated, the image forming apparatus includes: a main controller as a control circuit for controlling the whole image forming apparatus; an image processor for converting the obtained image data into a format of image data to be printed; an image memory for storage of the converted image data; and an image forming control unit for converting the image data obtained from the image processor into the image data to be given to control electrode 26.

The control electrode 26 is disposed in parallel to the tangent plane of the surface of opposing electrode 25 and spreads two-dimensionally facing opposing electrode 25, and it has a structure to permit the toner to pass therethrough from toner support 22 to opposing electrode 25. The electric field formed around the surface of toner support 22 varies depending on the potential being applied to control electrode 26, so that the jumping of toner 21 from toner support 22 to opposing electrode 25 is controlled.

Figure 9:
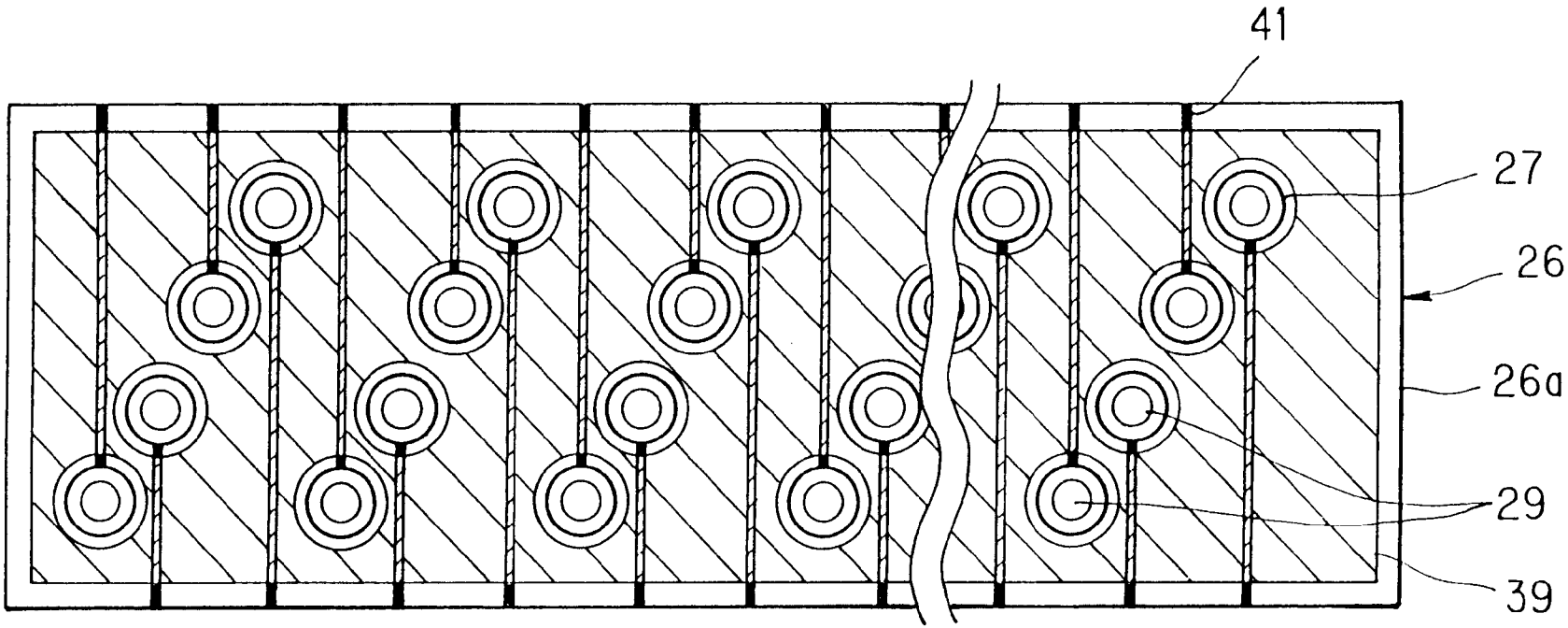
FIG. 9 is a configurational diagram showing a control electrode.

The control electrode 26 is arranged so that its distance from the peripheral surface of toner support 22 is set at 100 $\mu$m, for example, and is secured by means of an unillustrated supporter member. As shown in FIG. 9, control electrode 26 is composed of an insulative board **26*a*, a high voltage driver (not shown), annular conductors independent of one another, i.e., annular electrodes (gate electrodes) 27. Board 26*a* is made from a polyimide resin, for example, with a thickness of 25 $\mu$m. Board 26*a* further has holes forming gates 29, to be mentioned later, formed therein. Annular electrodes (gate electrodes) 27 are formed of copper foil of e.g., 18 $\mu$m thick and are arranged around the holes, in a predetermined layout on the side of board 26***a* which faces opposing electrode 25. Each opening of the hole is formed with a diameter of 160 μm, for example, forming a passage for toner 21 to jump from toner support 22 to opposing electrode 25. This passage will be termed gate 29 hereinbelow.

A shield electrode 39 which is also made up of copper foil and has an insulative layer 26*b* on the surface thereof is provided on the side closer to toner support 22 with respect to insulative board 26*a*. This shield electrode 39 has openings of 260 μm at the positions corresponding to gates 29. Here, the distance between control electrode 26 and toner support 22 is not particularly limited. Each annular electrode 27 has an opening of 200 μm in opening diameter.

The size of gates 29 and the materials and thickness of board 26*a* annular electrodes 27 and shield electrode 39 are not particularly limited. The number of annular electrodes 27 is not particularly limited as long as it is possible to obtain good print with a desired resolution. The surface of annular electrodes 27 as well as the surface of feeder lines 41 is coated with insulative layer 26*b* of 30 μm thick, which ensures insulation between annular electrodes 27, insulation between feeder lines 41, and insulation between annular electrodes 27 and feeder lines 41, which are not connected to each other. The material, thickness etc., of insulative layer 26*b* are not particularly limited.

Shield electrode 39 made up of copper foil of 18 μm thick with openings (having an aftermentioned opening diameter) at positions corresponding to gates 29 is arranged on the side facing toner support 22 of board 26*a*. The size of gates 29 and the materials and thickness of board 26*a* and annular electrodes 27 are not particularly limited. In the above case, gates 29 or the holes in annular electrodes 27 are formed at, for example, 2,560 sites. Each annular electrode 27 is electrically connected to a control power source 31 via feeder line 41 and a high voltage driver (not shown). The number of annular electrodes 27 is not particularly limited.

The surface of shield electrode 39, the surface of annular electrodes 27 and the surface of feeder lines 41 are covered with an insulative layer of 30 μm thick, which ensures insulation between annular electrodes 27, insulation between feeder lines 41 which are not connected with each other, insulation between annular electrodes 27 and feeder lines 41, insulation from toner support 22 and insulation from opposing electrode 25. The material, thickness etc., of the insulative layer are not particularly limited.

Supplied to annular electrodes 27 of control electrode 26 are voltages or pulses in accordance with the image signal from control power source (controlling means) 31. Specifically, when toner 21 carried on toner support 22 is made to pass toward opposing electrode 25, a voltage, e.g., 150 V is applied to annular electrodes 27. When the toner is blocked from passing, a voltage, e.g., −200 V is applied. Supplied to shield electrode 39 provided for control electrode 26 is a shield voltage of −30 V from a shield voltage power source 40. This shield voltage is effective in preventing toner 21 from adhering to control electrode 26 and in removing toner 21 adhering to control electrode 26 from a position of toner support 22.

In this way, whilst the potential to be imparted to control electrode 26 is controlled in accordance with the image signal, a sheet of paper 5 is fed over opposing electrode 25 on the side thereof facing toner support 22. Thus, a toner image is formed on the surface of paper 5 in accordance with the image signal. Here, control power source 31 is controlled by a control electrode controlling signal transmitted from an unillustrated image forming control unit.

Figure 10:
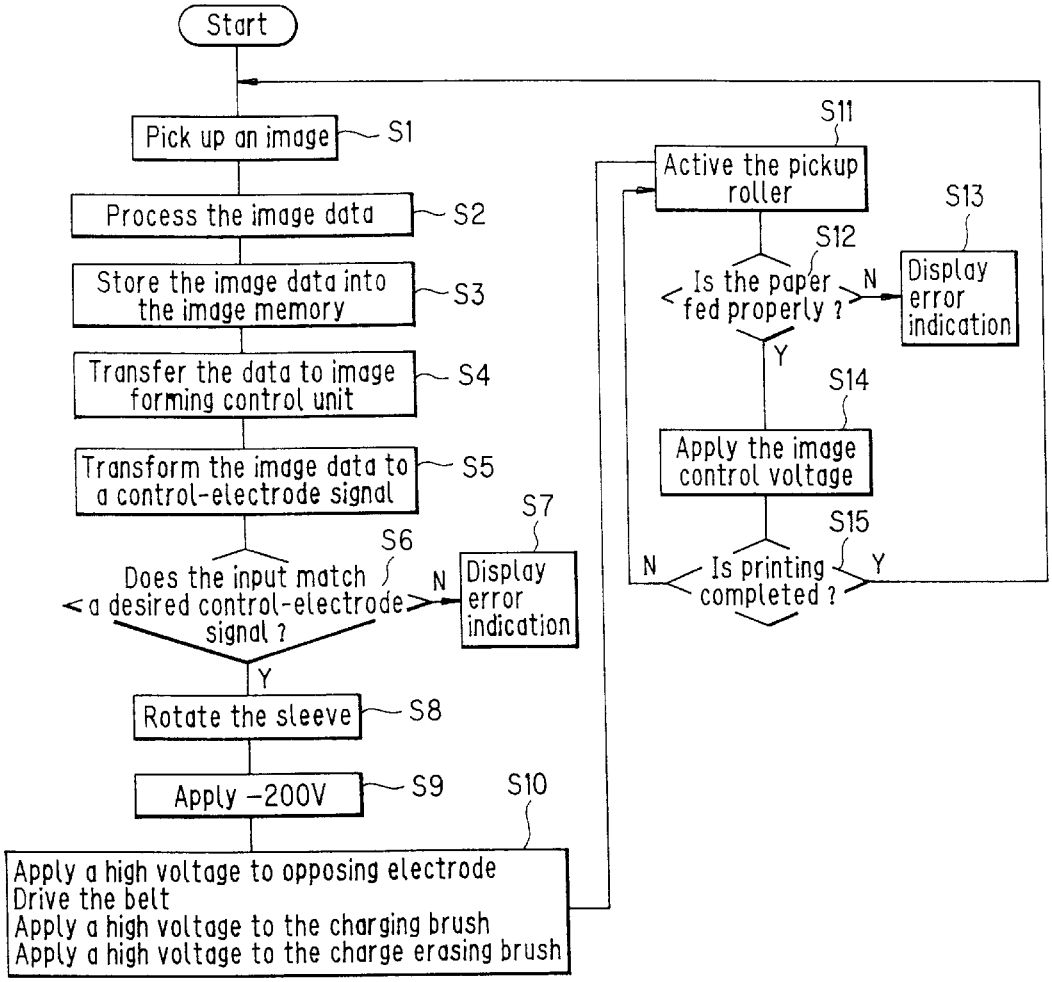
FIG. 10 is a flowchart showing the operation of the image forming apparatus.

The above image forming apparatus can be applied to an output printer for computers, word processors as well as the printing portion of digital copiers. The following description will be the case where the image forming operation of FIG. 10 is performed in the printing portion of a digital copier.

(Operation of the Apparatus)

Next, the above image forming apparatus used for a copying operation in a digital copier will be described with reference to the flowchart shown in FIG. 10.

First, when the user operates the copy start key (not shown) with an original to be copied set on the image pickup section (not coded with reference numeral), the image pickup section starts to read the image from the original (Step S1). The image data taken from the original image by the image pickup section is image processed in the image processing section (not shown) (Step S2) to be stored into the image memory (not shown) (Step S3). This image data is then transferred to the image forming control unit (not shown) (Step S4), and is converted into a control electrode controlling signal (Step S5).

When the image forming control unit acquires a predetermined amount of the control signal (Step S6; YES), toner support (sleeve) 22 of image forming unit 1 starts to rotate (Step S8) and a voltage of −200 V is applied to annular electrodes of the control electrode (Step S9). Predetermined voltages are applied to opposing electrode 25, charging brush 14 and charge erasing brush 32, respectively and dielectric belt 24 is activated (Step S10). When the input does not match a desired control electrode signal (Step S6; NO), this flow is interrupted, and an error indication is displayed (Step S7).

Next, pickup roller 6 of paper feeder 10 is operated (Step S11) so as to pick up a sheet of paper 5. The paper 5 thus picked up is sent out to image forming unit 1 and conveyed at the predetermined speed over the flat portion of opposing electrode 25 whilst it is being attracted to a paper sucking mechanism. When paper feeding is properly performed (Step S12; YES), the image forming control unit supplies the control electrode controlling signal to control power source 31 at a time synchronized with the feeding (conveyance) of paper 5. Control power source 31 applies a driving signal (image control voltage) to control electrode 26 in accordance with the control electrode controlling signal (Step S14) so as to control the jumping of the toner flow, forming a toner image on paper 5 (i.e., achieving printing). It should be noted that the predetermined amount of the control electrode controlling signal is different depending upon the configuration of the image forming apparatus. If paper feeding is not performed properly (Step S12; NO), this flow of operation is interrupted and an error indication is displayed (Step S13).

The toner image is pressed whilst being heated by fixing unit 11. Paper 5 with a toner image fixed thereon is discharged by the discharge roller onto the paper output tray. When the paper discharge sensor detect the fact that the paper is properly discharged, printing (the operation of image forming) is judged to be properly complete (Step S15; YES). Then, the operation returns to Step S1 for a subsequent original reading operation.

By the image forming operation described above, a good image is created on paper 5. Since this image forming apparatus directly forms the image on paper 5, it is no longer necessary to use a developer medium such as photoreceptor, dielectric drum, etc., which were used in conventional image forming apparatuses. As a result, the transfer operation for transferring the image from the developer medium to paper 5 can be omitted, thus eliminating degradation of the image and improving the reliability of the apparatus. Since the configuration of the apparatus can be simplified needing fewer parts, it is possible to reduce the apparatus in size and cost.

(Operation of the Image Forming Unit)

Next, the operation of image forming unit 1 is described in detail.

The image forming apparatus of the above embodiment may be used as the printing portion of an output terminal for a computer or may be used as the printing portion of a digital copier. In either case, the method of the image forming operation itself has no difference from the other though the image signal to be processed and the way of signal exchange differ in each case.

As stated already, toner support 22 is grounded while opposing electrode 25 and support member 16*a* have a high voltage of 2.3 kV applied and charging brush 8 has a high voltage of 1.2 kV applied. As a result, negative charge is supplied to the surface of paper 5 fed between charging brush 8 and dielectric belt 24, by the potential difference between charging brush 8 and support member 16*a*. As supplied with negative charge, paper 5 is attracted to dielectric belt 24 by the static electric force of the charge and is conveyed to directly below gates 29 as dielectric belt 24 moves. The charge on the surface of dielectric belt 24 dissipates, hence, when it reaches directly below gates 29 the paper will have a surface potential of 2 kV due to the equilibrium with the potential of opposing electrode 25.

In this condition, in order for toner 21 carried on toner support 22 to pass toward opposing electrode 25, control power source 31 is caused to apply a voltage of 150 V to annular electrodes 27 of control electrode 26. When toner 21 needs to be stopped passing through gates 29, a voltage of −200 V is applied. In this way, with paper 5 being attracted to dielectric belt 24, the image is directly formed on the surface of paper 5.

In the above description, the voltage applied to annular electrodes 27 of control electrode 26 for allowing passage of toner 21 was set at 150 V as an example. This voltage, however, is not specifically limited as long as the jumping control of toner 21 can be performed as desired. Similarly, the voltage applied to opposing electrode 25, the voltage applied to charging brush 8 and the surface potential of paper 5 directly below gates 29 are not particularly limited as long as the jumping control of toner 21 can be performed as desired.

The voltage to be imparted to annular electrodes 27 of control electrode 26 to prevent passage of toner 21 should not be particularly limited as long as it does not depart from the scope of the invention.

(Control electrode in accordance with the invention)

In the invention, a voltage equal to the surface potential of the toner layer is applied from shield power source 40 to shield electrode 39 so as to eliminate the potential difference between the toner layer surface and shield electrode 39, thus preventing the jumping of toner 21 and hence avoiding its adherence, which would be caused by the electric field formed by the potential difference. In the above embodiment, since the surface potential of the toner 21 layer is at −30 V, shield electrode 39 is supplied with −30 V from shield power source 40.

In the above embodiment, the OFF potential applied to annular electrodes 27 is set at −200 V. Accordingly, negatively charged toner may adhere to annular electrodes 27 as stated above. In general, the negatively charged toner can be removed when the potential of annular electrodes 27 is switched into the ON potential (150 V) for transfer of toner 21. However, the adhering toner 21 cannot be removed in some cases depending upon the characteristics of toner 21 used or the usage environment of the apparatus, causing the deficiencies described in the section of 'description of the prior art'. In order to avoid the deficiencies, it is also possible to apply a voltage equal to the surface potential of toner 21 carried on toner support 22 as the OFF potential applied to annular electrodes 27. In this case, the potential of opposing electrode 25 and the position of control electrode 26 need to be adjusted appropriately.

Figure 11:
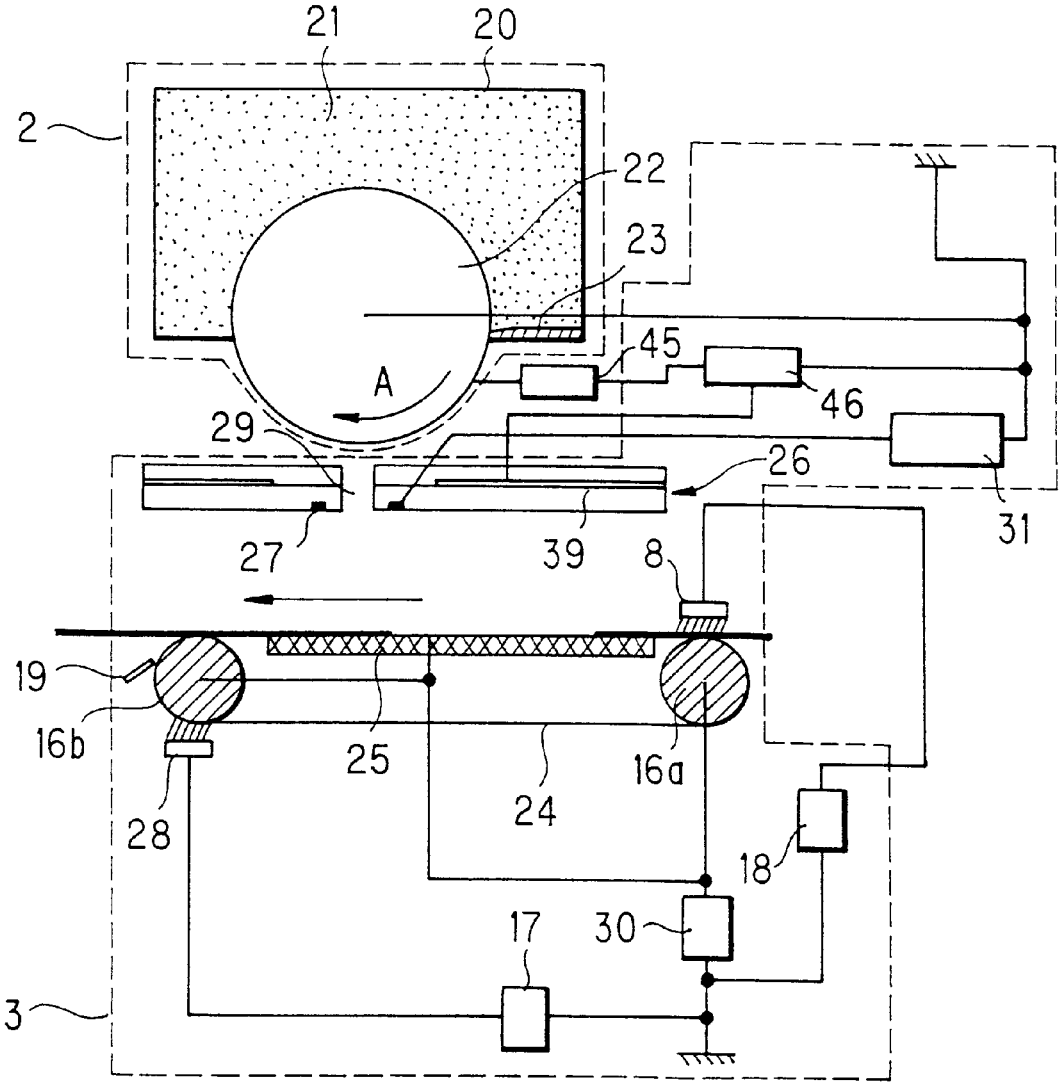
FIG. 11 is a schematic diagram showing essential components of an image forming apparatus having a detecting means for detecting the surface potential of the toner layer.

In the above embodiment, the output voltage from shield power source 40 is set at a fixed voltage, −30 V. There are cases where the surface potential of the toner 21 layer is subject to variation depending upon the characteristics of the toner used. For example, when the usage environment of the apparatus is changed, or when various components including blade 23, in the apparatus become aged, the surface potential of the toner layer may easily change. Since the surface potential of the toner 21 layer changes, a potential difference occurs between toner 21 of the topmost surface of the toner layer and the shield voltage which is supplied at a fixed level. The electric field generated by this potential difference make toner 21 jump easily causing toner adherence and hence deficiencies. To deal with such cases, it is possible to make the output voltage from the shield power source to shield electrode 39 and/or annular electrodes 27 variable. In this case, it is preferable to configure the apparatus in such a way that this output voltage is controlled by separately having a detecting means 45 for measuring the surface potential of the toner 21 layer and providing a shield electrode power source 46 which can output the same voltage as the surface potential of the toner 21 layer measured by detecting means 45, as shown in FIG. 11.

Figure 12:
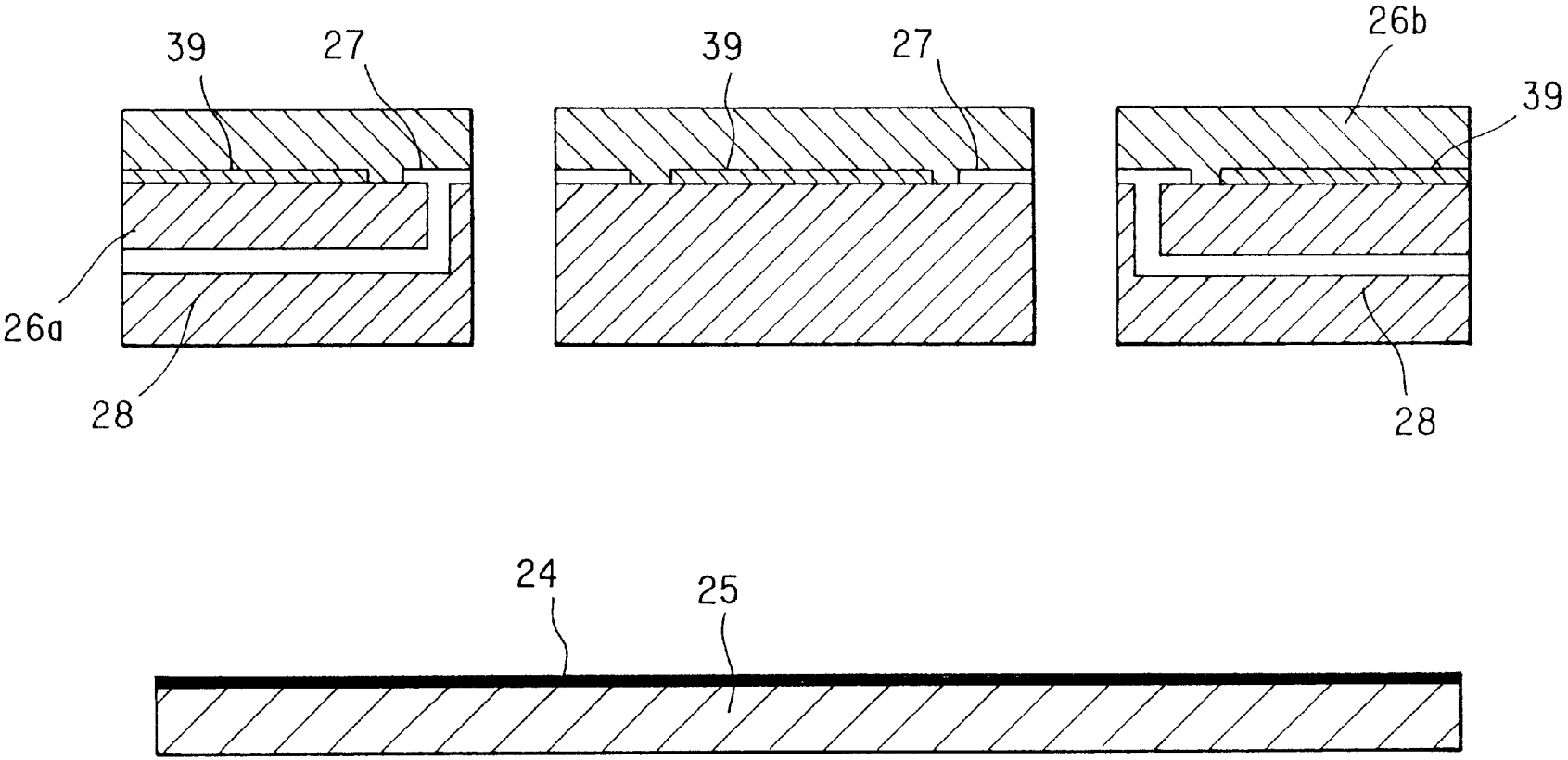
FIG. 12 is a sectional view showing another embodiment of a control electrode in accordance with the present invention.

As for the arrangement of shield electrode 39 and annular electrodes 27, shield electrode 39 and annular electrodes 27 may be provided in a planar configuration as shown in FIG. 12.

In FIG. 12, feeder line 28 connecting each annular electrode 27 with control power source 31 is provided on the side closer to opposing electrode 25 with respect to shield electrode 39 and shield electrode 39 and annular electrodes 27 are configured in a planer arrangement. In this configuration, feeder lines 28 are electrically hidden by shield electrode 39 from toner 21 carried on toner support 22, the aforementioned deficiencies will not occur at all. This arrangement enables annular electrodes 27 to be positioned closer to toner support 22, so that it is possible to reduce the potential difference required for controlling the jumping of toner 21. Accordingly, the withstanding voltage of the transistors used for the voltage switching means can be reduced. This is effective in reducing the cost of the voltage switching means.

It should be noted that the output voltage from shield power source 40 is not particularly limited.

Figure 13:
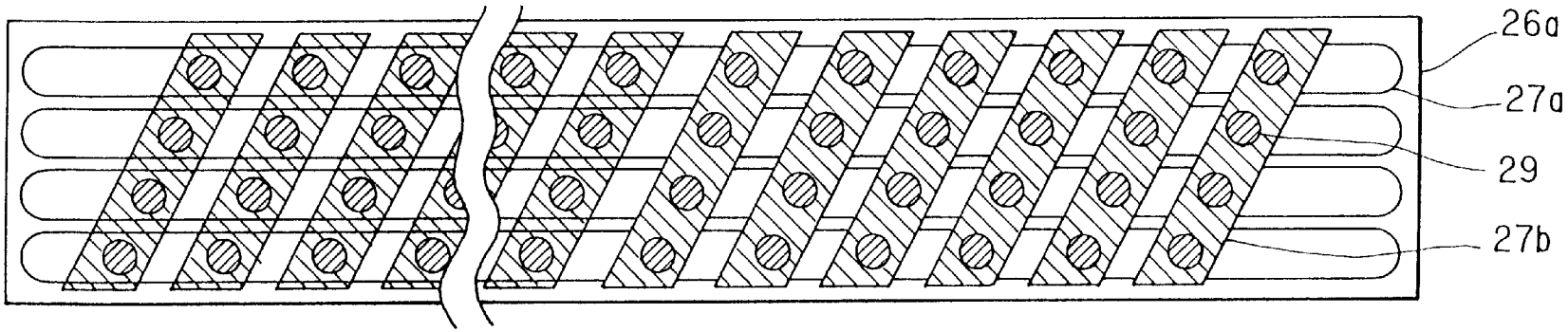
FIG. 13 is a schematic diagram showing a matrix type control electrode.

In the above embodiment, control electrode 26 has a single drive configuration in which each opening is controlled by a different electrode, but the same effect can be obtained by using a control electrode 26 shown in FIG. 13 of a matrix drive configuration using matrix control. Use of an electrode of the matrix control type can markedly reduce the number of drivers required. For example, in the case of the control electrode shown in FIG. 13, the required drivers can be reduced to about one-fourth as many as those needed for the control electrode shown in FIG. 9, thus making it possible to markedly reduce the number of parts and the size and cost of the apparatus.

Figure 14:
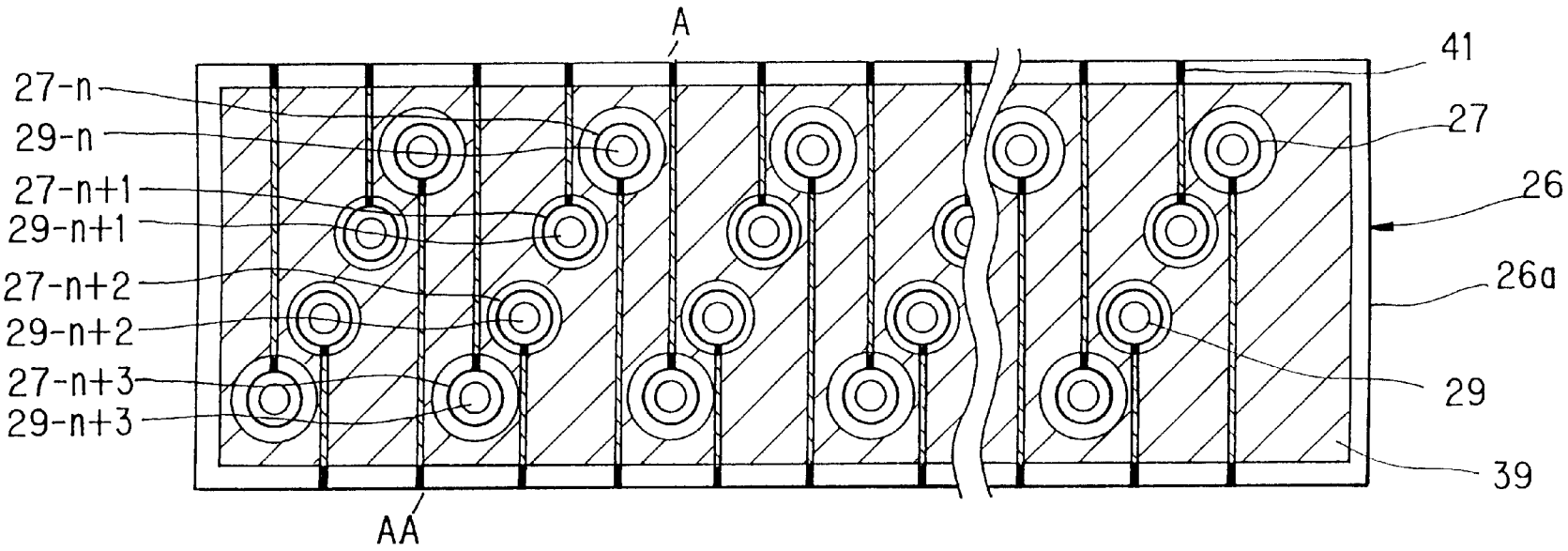
FIG. 14 is a schematic view showing another embodiment of a control electrode in accordance with the present invention.
Figure 15:
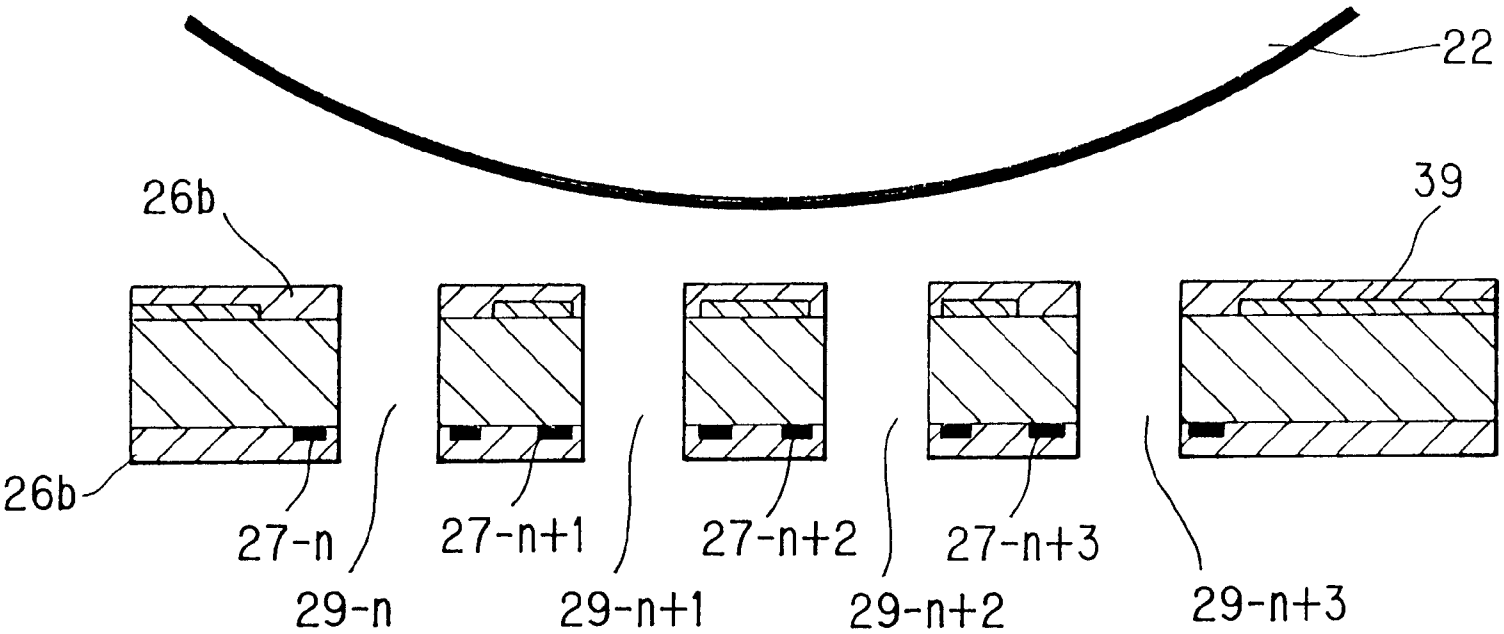
FIG. 15 is a sectional view of the control electrode shown in FIG. 14.

FIG. 14 is a configurational diagram showing another type of control electrode 26. Since this control electrode is basically the same as that shown in FIG. 9, the same elements are designated by the same reference numerals. FIG. 15 is a sectional view taken on A-AA of this control electrode.

Figure 16:
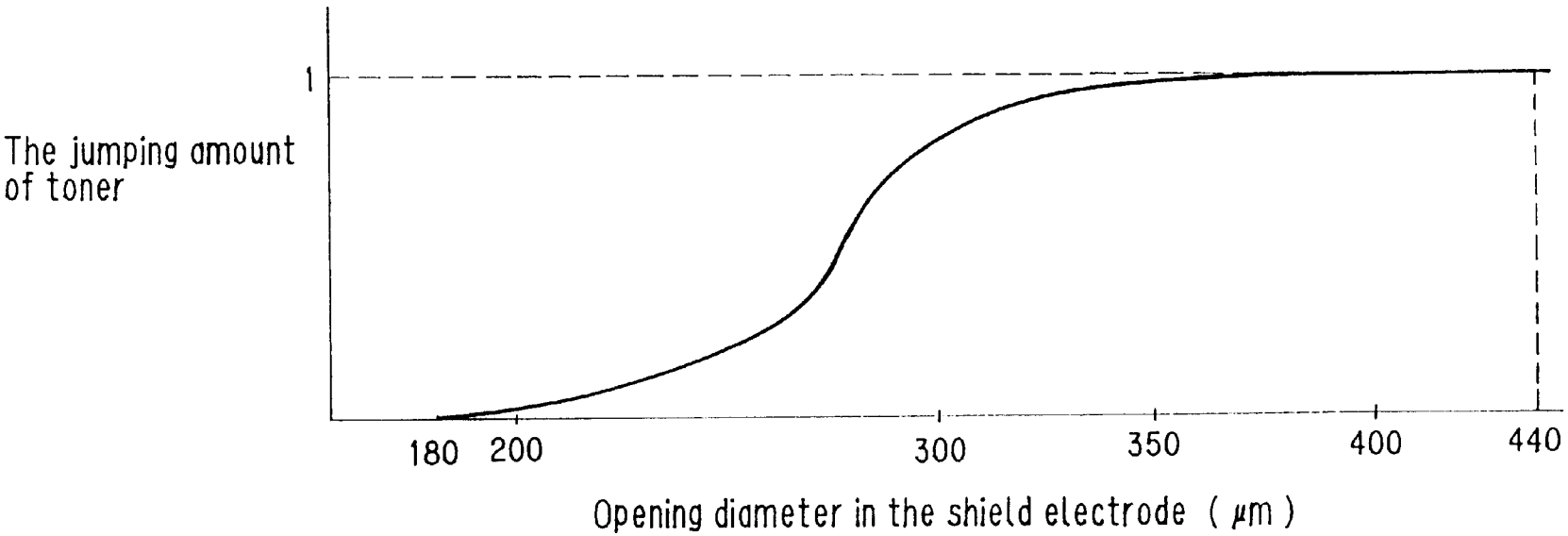
FIG. 16 is a chart showing the relationship between the opening diameter of the opening in the shield electrode and the amount of jumping toner.

In the section of control electrode 26, the diameters of the opening in shield electrode 39 are different depending upon the distance between control electrode 26 and toner support 22. Specifically, the diameters of the openings in gates 29-n and 29-n+3 are set at 260 $\mu$m and the diameters of the openings in gate 29-n+1 and 29-n+2 are set at 220 $\mu$m. In this embodied configuration, change in diameter of the opening in shield electrode 39 can adjust the amount of toner 21 jumping through gate 29. For example, as shown in FIG. 16, as the diameter of the opening in the shield electrode 39 is enlarged, the amount of toner 21 jumping increases. In this embodiment, the amount of the jumping toner is not influenced by the diameter of the opening of shield electrode 39 and reaches a saturated level when the diameter of the opening of shield electrode 39 is 350 $\mu$m or more. Conversely, as the opening diameter of shield electrode 39 is made smaller, the amount of the jumping toner reduces and no toner will jump when the opening diameter is lower than 180 $\mu$m in FIG. 16. In FIG. 16, the amount of the jumping toner is normalized by the amount of the jumping toner when the opening diameter of shield electrode 39 is 440 $\mu$m. Since the values of the characteristics as shown in FIG. 16, for example, the value of the saturation amount of toner, 350 $\mu$m, and the value of the threshold below which no toner jump occurs, 180 $\mu$m, readily vary depending upon the characteristic of toner 21 used, the state of the toner carried on toner support 22, the position, opening diameter and the potential of annular electrodes 27, these values are not particularly limited.

Accordingly, characteristics similar to that shown in FIG. 16 can be obtained by taking the relative position of shield electrode 39 to toner support 22 and annular electrodes 27 or the potential of shield electrode 39 as the variable parameter for abscissa. For example, characteristics similar to that shown in FIG. 16 can be obtained by controlling the position of shield electrode 39, but this needs a very high precision of positioning. Therefore, when it is difficult to keep the positional accuracy due to the configuration of the image forming apparatus, control by the diameter of the openings in the shield electrode 39 or control of its potential is preferable.

On the other hand, when the position of shield electrode 39 can be easily adjusted with high precision, it is possible to perform the above control based on the position of shield electrode 39, and it becomes possible to perform reliable fine control by controlling the potential in combination. Among the parameters of the position of the shield electrode, the potential of shield electrode 39 and the diameter of the openings, the most effective one is different depending upon the characteristics of the image forming apparatus used, and should be determined appropriately based on the characteristics of the image forming apparatus.

Within these characteristics, typically shown in FIG. 16, the degree of exposure of annular electrode 27 to the surface of toner support 22 varies depending upon the opening diameter, position and potential of shield electrode 39. This means that the area on the surface of toner support 22 from which toner 21 can jump varies. That is, in the above embodiment, the amount of jumping toner 21 can become easily varied based on the opening diameter, position and potential of shield electrode 39. In the conventional art, it is considered that adjustment of the amount of jumping toner 21 is varied by varying the potential applied to annular electrodes. However, this conventional configuration needs FETs of a higher withstanding voltage for the voltage switching means, unavoidably resulting in an increased number of parts for circuits and increase in size and cost of the apparatus. On the contrary, in the configuration of this embodiment, no voltage switching means is needed even if the voltage applied to shield electrode 39 needs to be changed. Therefore, there is no cost increase from such a switching means. Besides, in the case where the opening diameter and/or position of shield electrode 39 is varied so as to adjust the amount of jumping toner 21, no extra power sources are needed, a marked difference from the case where the potential of shield electrode 39 is varied. Therefore, there is no cost increase relating to the power source.

In the above embodiment, the degree of electrical exposure of each annular electrode 27 is varied in accordance with its distance from toner support 22. For example, gates 29-n and 29-n+3 which are more distant from toner support 22 are adapted to have openings greater in diameter in shield electrode 39 so as to enlarge the electric field-forming area around toner support 22 and hence increase the amount of jumping toner 21. Conversely, when the opening of shield electrode 39 is not as large as that of annular electrode 27, the forming area of the jumping electric field of toner 21 generated near the surface of toner support 22 by the potential of annular electrode 27 is made narrower by the potential of shield electrode 39, thus reducing the amount of jumping toner 21.

In the geometry of the electrode in the conventional art, the distance of gates 29-n or 29-n+3 from toner support 22 is greater than that from 29-n+1 or 29-n+2. Therefore, if the same voltage as applied to annular electrodes 27-n+1 and 27-n+2 is applied to annular electrodes 27-n and 27-n+3, the electric field generated by gates 29-n or 29-n+3 from the voltage causing toner 21 to jump is weaker and its electric field forming area becomes smaller than the cases of gates 29-n+1 and 29-n+2. In this case, in gates 29-n or 29-n+3 (to be referred to as off-center gates 29), adequate jump of toner 21 cannot be obtained. This produces an image with insufficient contrast, making it difficult to achieve faithful reproduction of halftones. Further, as in gates 29-n+1 and 29-n+2 at the center (to be referred to center gates) which are located a relatively short-distance from toner support 22, a large amount of toner 21 will jump, so that density unevenness occurs between off-center gates 29 and center gates 29, causing image degradation.

On the other hand, if the amount of toner passing through off-center gates 29 is adjusted to a sufficient level, the amount of toner 21 passing through center gates 29 becomes greater than that required, causing not only unnecessary increment in the consumption of toner 21 but also making the resulting image itself unnatural. However, in the aforementioned embodiment, by the above configuration, the electric field forming region from where toner 21 can jump is adjusted by the level of the potential of each annular electrode 27, so as to make the amount of toner jumping to each gate 29 uniform or regulate it at a predetermined level. Accordingly, the aforementioned deficiencies will not occur, thus allowing a uniform or predetermined amount of toner 21 to jump to each gate 29, and hence making it possible to perform excellent image forming.

Figure 17:
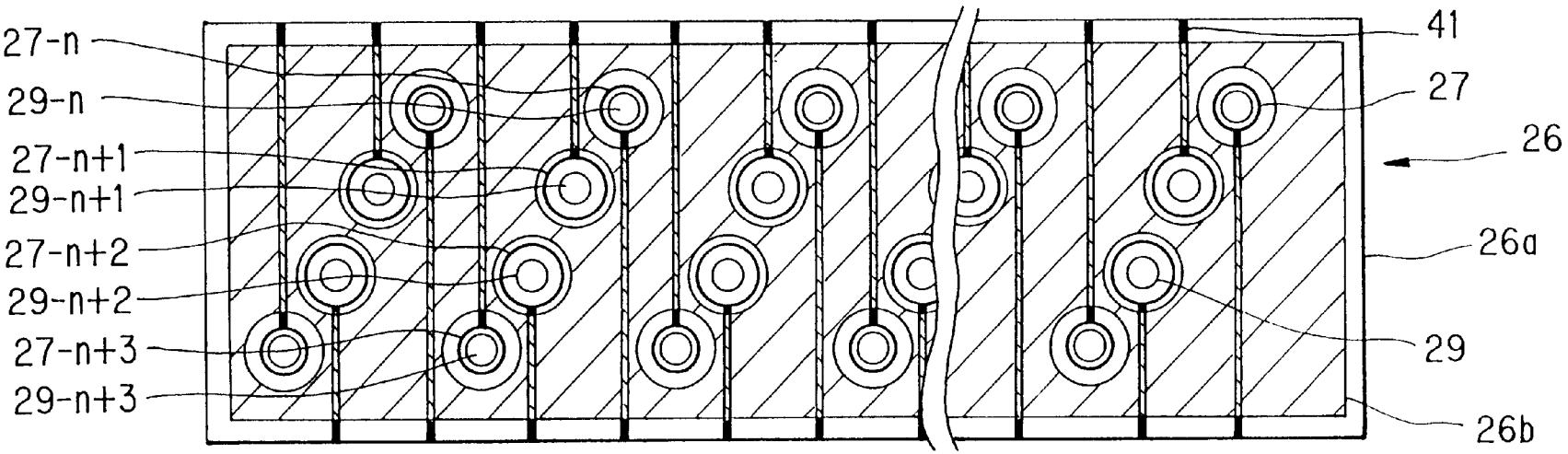
FIG. 17 is a schematic view showing another embodiment of a control electrode in accordance with the present invention.

FIG. 17 shows another embodiment of a control electrode. In FIG. 17, in place of the openings of shield electrode 39, the size of the openings of annular electrodes 27 is varied depending upon the distance between control electrode 26 and toner support 22. This configuration makes the amount of toner 21 passing through off-center gates 29 equal to that through center gates 29, enabling excellent image forming.

In the configuration shown in FIG. 17, some annular electrodes 27, e.g., 27-n+1 and 27-n+2, become larger than others. If annular electrodes 27 cannot be made large enough due to requirements of the arrangement of gates 29 in control electrode 26, or requirements of image resolution, or requirements of the arrangement or thickness of the feeder lines, the configuration shown in FIG. 14 is preferable. In the configuration shown in FIG. 14, the size of the openings of shield electrode 39 is the only critical factor and problems relating to the pattern will not occur.

Figure 18:
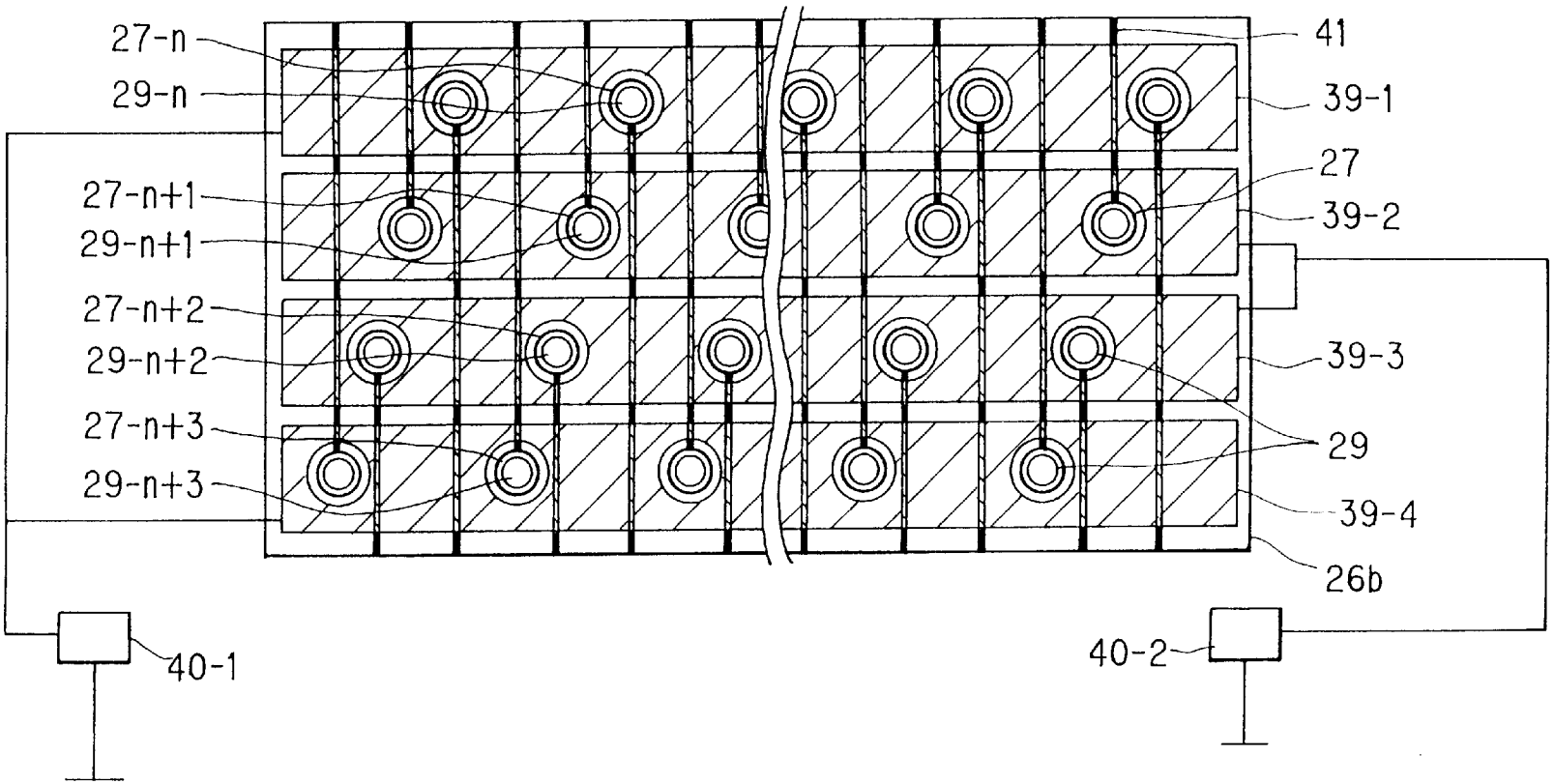
FIG. 18 is a schematic view showing another embodiment of a control electrode in accordance with the present invention.

FIG. 18 shows another embodiment of a control electrode. In FIG. 18, a plurality of sectioned shield electrodes 39 are provided for control electrode 26 (four sectioned shield electrodes 39-1 to 39-4 in FIG. 18), depending upon the positional relationship between control electrode 26 and toner support 22. Further, shield electrodes 39-1 and 39-4 have a voltage of −10 V applied from shield power source 40-1 and shield electrodes 39-2 and 39-3 have a voltage of −50 V applied from shield power source 40-2. That is, instead of manipulating the size of the openings of shield electrode 39, the level of the voltage applied to shield electrode is varied depending upon the distance between toner support 22 and control electrode. By this configuration, the electric fields formed in the regions facing off-center gates 29 and center gates 29 are controlled so as to make the amounts of toner 21 passing through off-center gates 29 and center gates 29 uniform, thus enabling achievement of excellent image forming.

In contrast to the configuration shown in FIG. 18, varying the voltage applied to annular electrodes 27 in accordance with the distance between toner support 22 and control electrode 26 in order to make toner 21 pass through each of gates 29 at a uniform amount may also be considered. In this case, there occur cases where the withstanding voltage of the FETs used for the voltage switching means must be raised as necessary, depending on the voltage to be applied, which results in the need of increased cost for the FETs. On the contrary, the embodiment of the invention described above in FIG. 18, no voltage change is needed so that no increase in cost relating to FETs will occur. If the difference in size between the opening of annular electrode 27 and the opening of shield electrode 39 is small, a very high precision will be needed for the alignment of the openings with each other. However, in the configuration shown in FIG. 18, it is possible to set the ratio of the opening diameter of annular electrode 27 to that of shield electrode 39, at a relatively large value, so that it is possible to ensure a relative large margin for the alignment.

Figure 19:
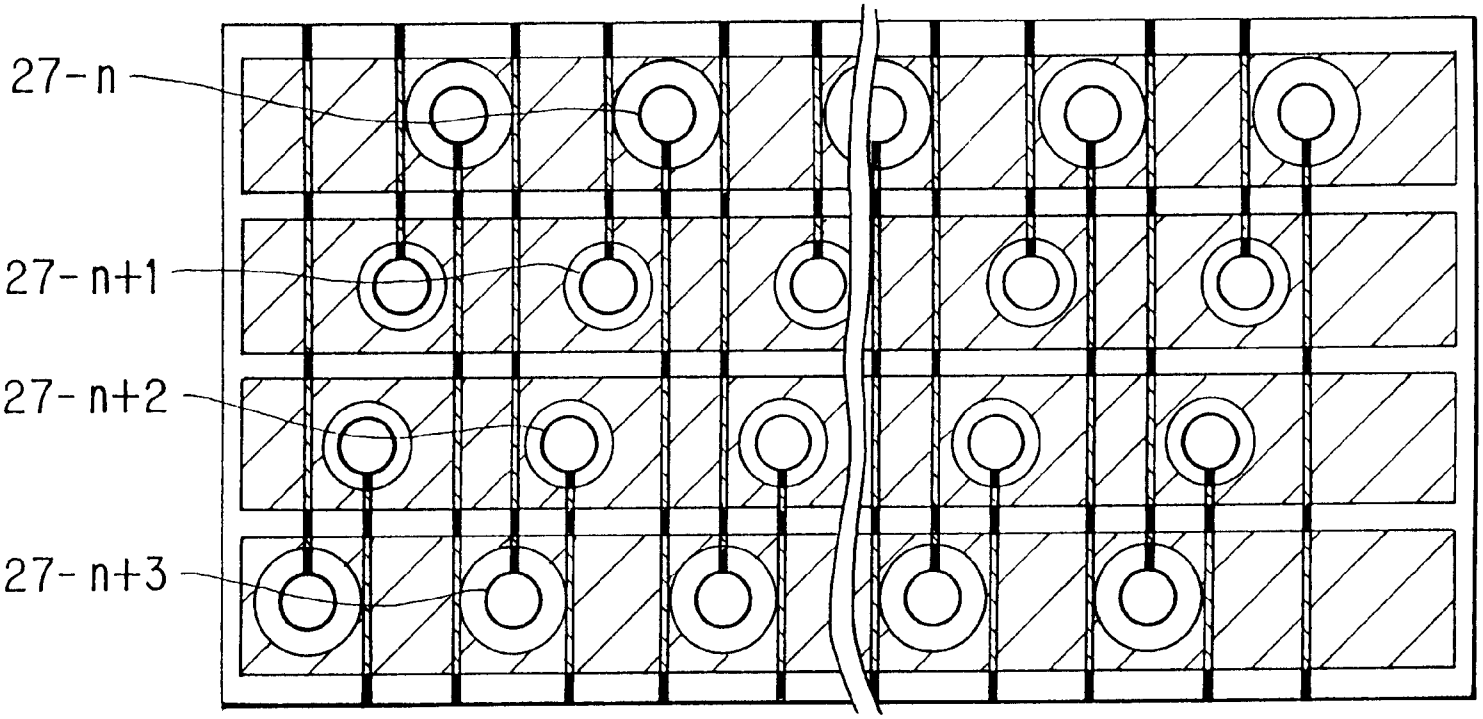
FIG. 19 is a schematic view showing another embodiment of a control electrode in accordance with the present invention.

FIG. 19 shows another embodiment of a control electrode. In FIG. 19, reference will be made to the openings of shield electrode 39 and the shape of annular electrodes 27, omitting the reference to gates 29. In FIG. 19, four sectioned shield electrodes 39 are provided as in FIG. 18. In this case, however, instead of applying a different voltage to each sectioned shield electrode 39, the diameter of the openings of shield electrode 39 is differentiated from one sectioned shield electrode 39 to another. This changes the degree of exposure of each annular electrode 27 changes. In this configuration, multiple numbers of shield power sources 40, as needed in FIG. 18, will not be needed, thus increase in cost from the power sources can be avoided.

Figure 20:
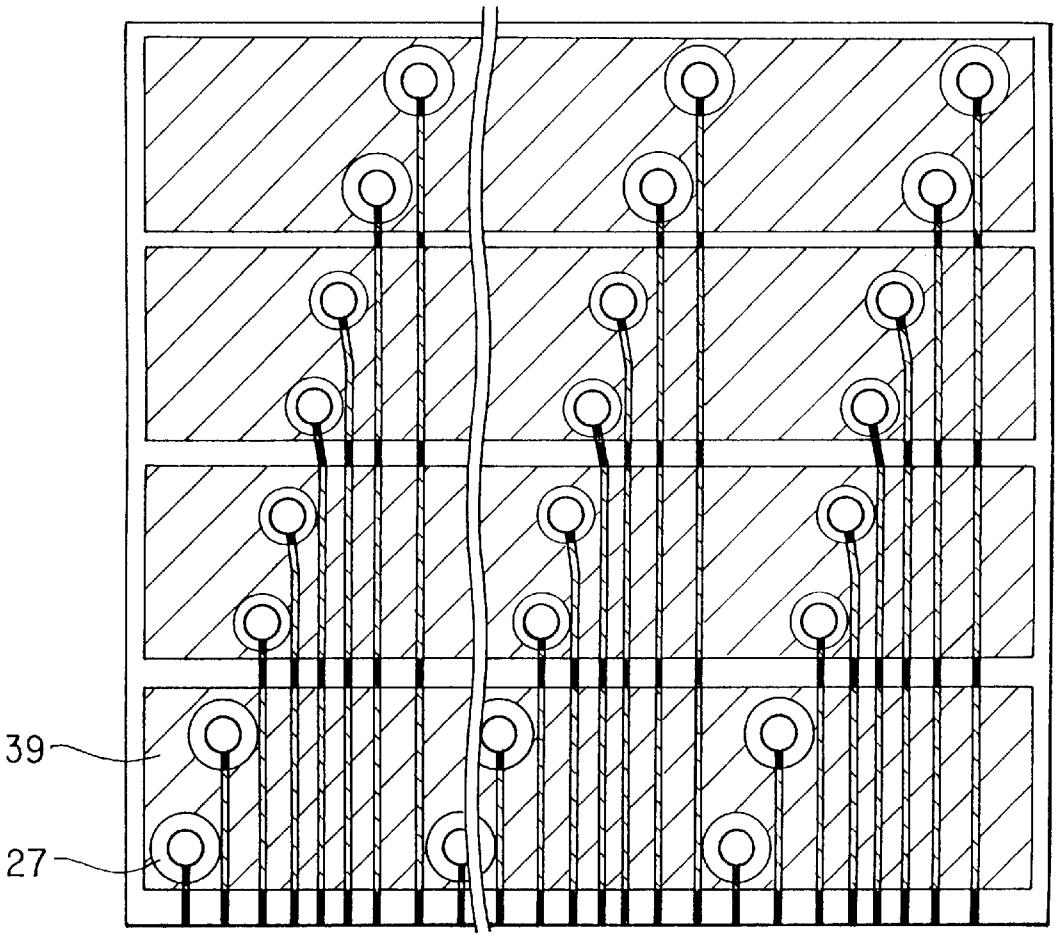
FIG. 20 is a schematic view showing another embodiment of a control electrode in accordance with the present invention.
Figure 21:
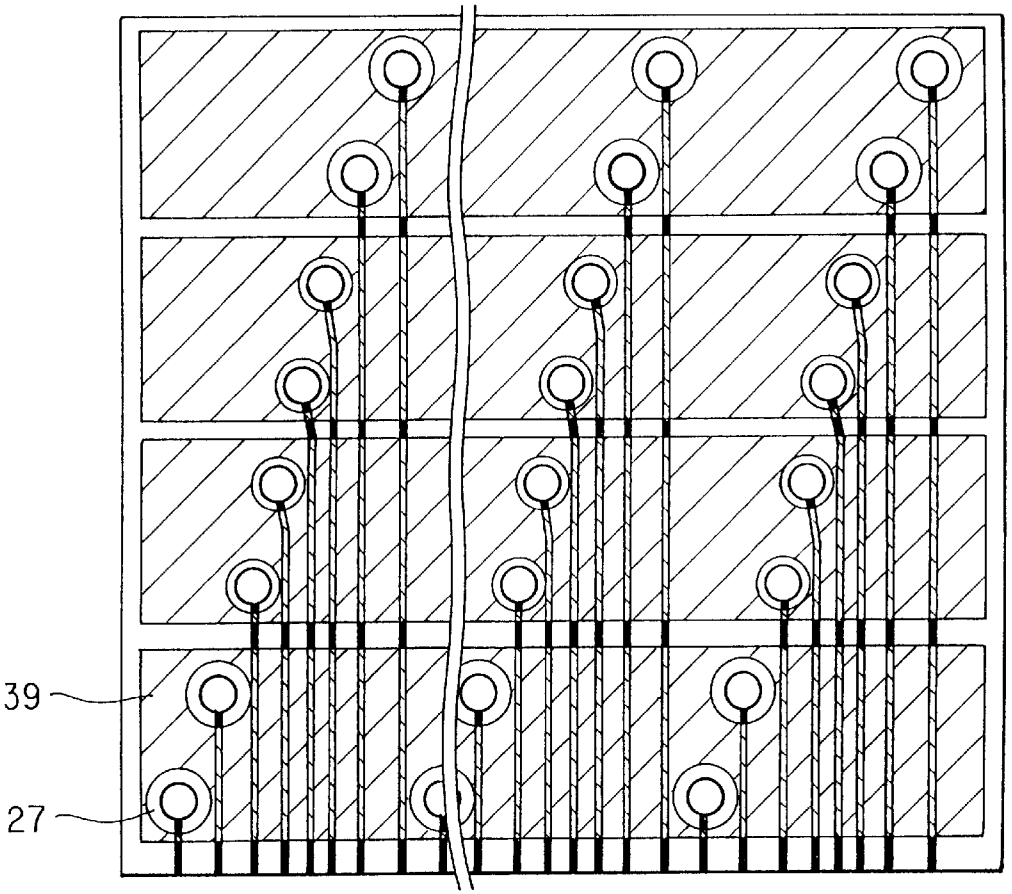
FIG. 21 is a schematic view showing another embodiment of a control electrode in accordance with the present invention.

Since the openings in each sectioned shield electrode 39 have an identical diameter in the configuration of FIG. 19, the production step of each sectioned shield electrode 39 is simple, making it possible to reduce the cost increase, but this configuration needs a finer control of toner jumping. Accordingly, it is also possible to make a configuration shown in FIG. 20 when plural rows of gates 29 are arranged in each sectioned shield electrode 39. When a two row arrangement as shown FIG. 20 is adopted, a configuration wherein the openings within each sectioned shield electrode 39 are varied in diameter as shown in FIG. 21 enables a further fine or manipulative control for generation of the electric field near the surface of toner support 22, and this configuration is more advantageous in controlling the amount of toner 21 jumping through each electrode 29. However, if it is not possible to provide a large margin for the alignment between the openings of annular electrodes 27 and shield electrode 39, the configuration shown in FIG. 20 is relatively preferable.

Figure 22:
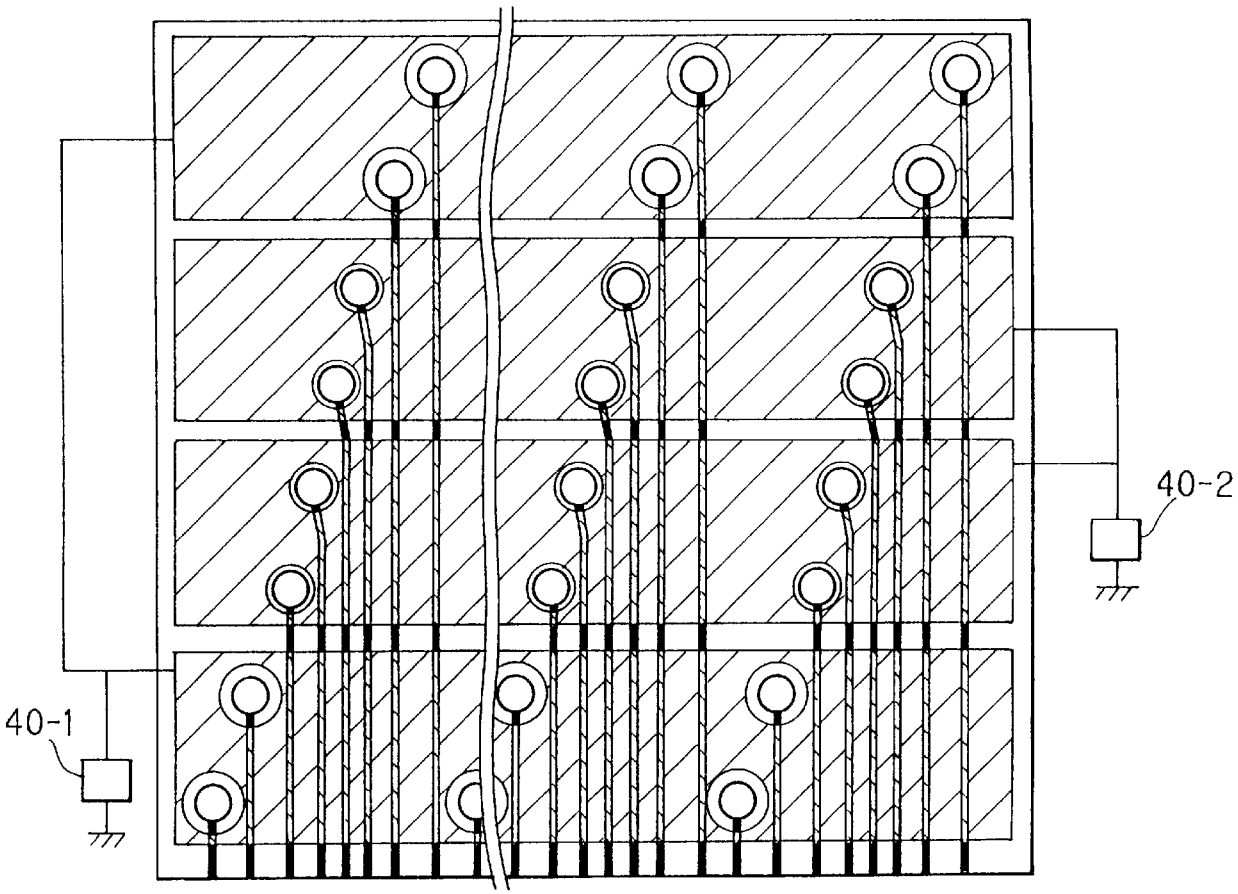
FIG. 22 is a schematic view showing another embodiment of a control electrode in accordance with the present invention.

Further, in some environments under which the apparatus is used, it may be impossible to make the amount of toner 21 passing through gates 29 completely uniform when a control electrode 26 having a form of FIG. 19 through FIG. 21 is used in a high temperature, high humidity environment. In such a case, it is preferable that sectioned shield electrodes 39 are provided as shown in FIG. 22, each sectioned shield electrode being adapted to have an appropriate voltage applied from shield power source 40-1 or 40-2 and each of the openings being varied in diameter. The differentiation in size of the openings is ideally made for each of gates 29 as shown in FIG. 17, but the size may be adjusted for each of sectioned shield electrodes 39 as shown in FIG. 20.

Figure 23:
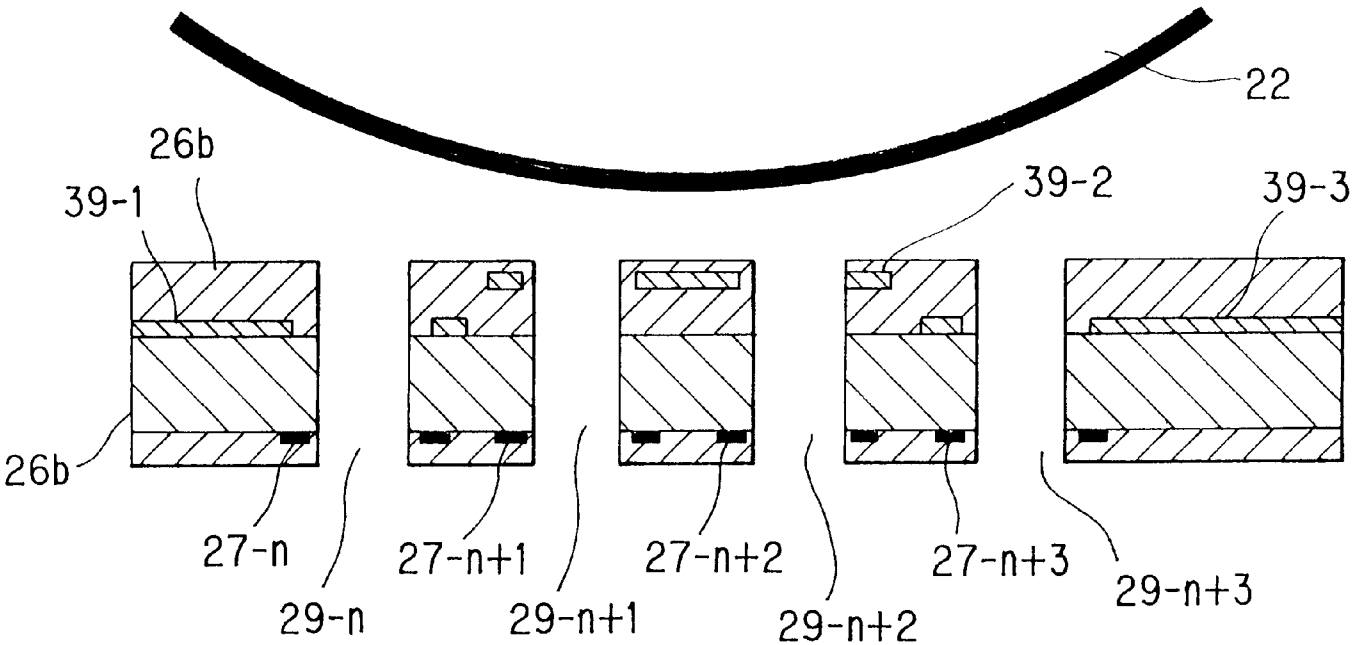
FIG. 23 is a sectional view showing another embodiment of a control electrode in accordance with the present invention.

In the above embodiment, the degree of electrical exposure of annular electrode 27 is controlled by adjusting the ratio between the opening diameter of annular electrode 27 and the diameter of the openings of shield electrode 39, and manipulating the voltage applied to each sectioned shield electrode 39. However, the margin for the alignment of the openings may become small in the above embodiment, possibly causing increase in cost. Further, the increase in the number of power sources may also cause increase in cost. In this case, it is also possible to adaptively arrange sectioned shield electrodes 39 in accordance with the positional relationship between annular electrode 27 and toner support 22. IN FIG. 23, for annular electrodes 27-n+2 and 27-n+1 which are located closer to toner support 22, sectioned shield electrode 39-2 is arranged more distant from annular electrodes 27-n+1 and 27-n+2 and closer to toner support 22. On the other hand, for annular electrodes 27-n and 27-n+3, sectioned shield electrodes 39-1 and 39-3 are arranged closer to annular electrode 27 than shield electrode 39-2. This arrangement makes the degree of exposure of annular electrodes 27 to toner support 22 uniform, enabling uniform jumping of toner 21.

Figure 24:
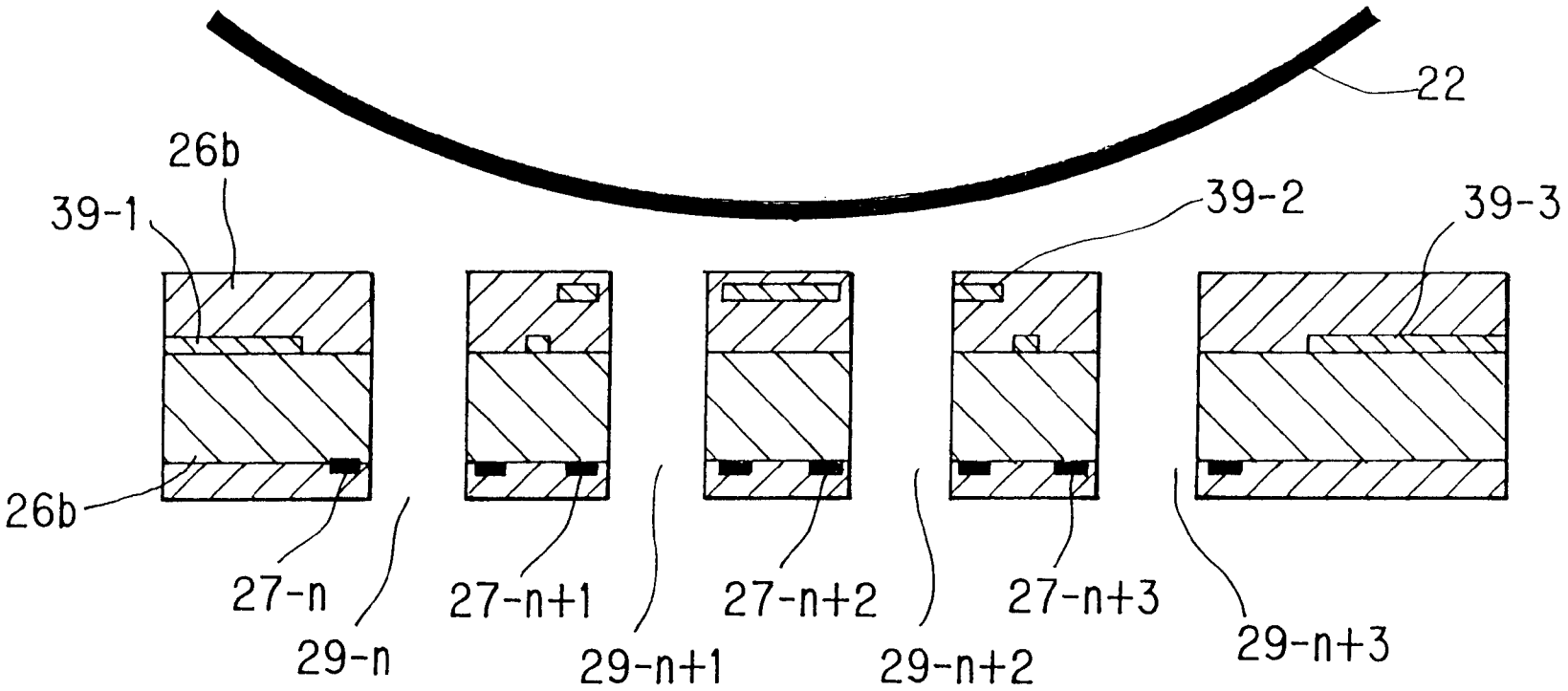
FIG. 24 is a sectional view showing another embodiment of a control electrode in accordance with the present invention.
Figure 25:
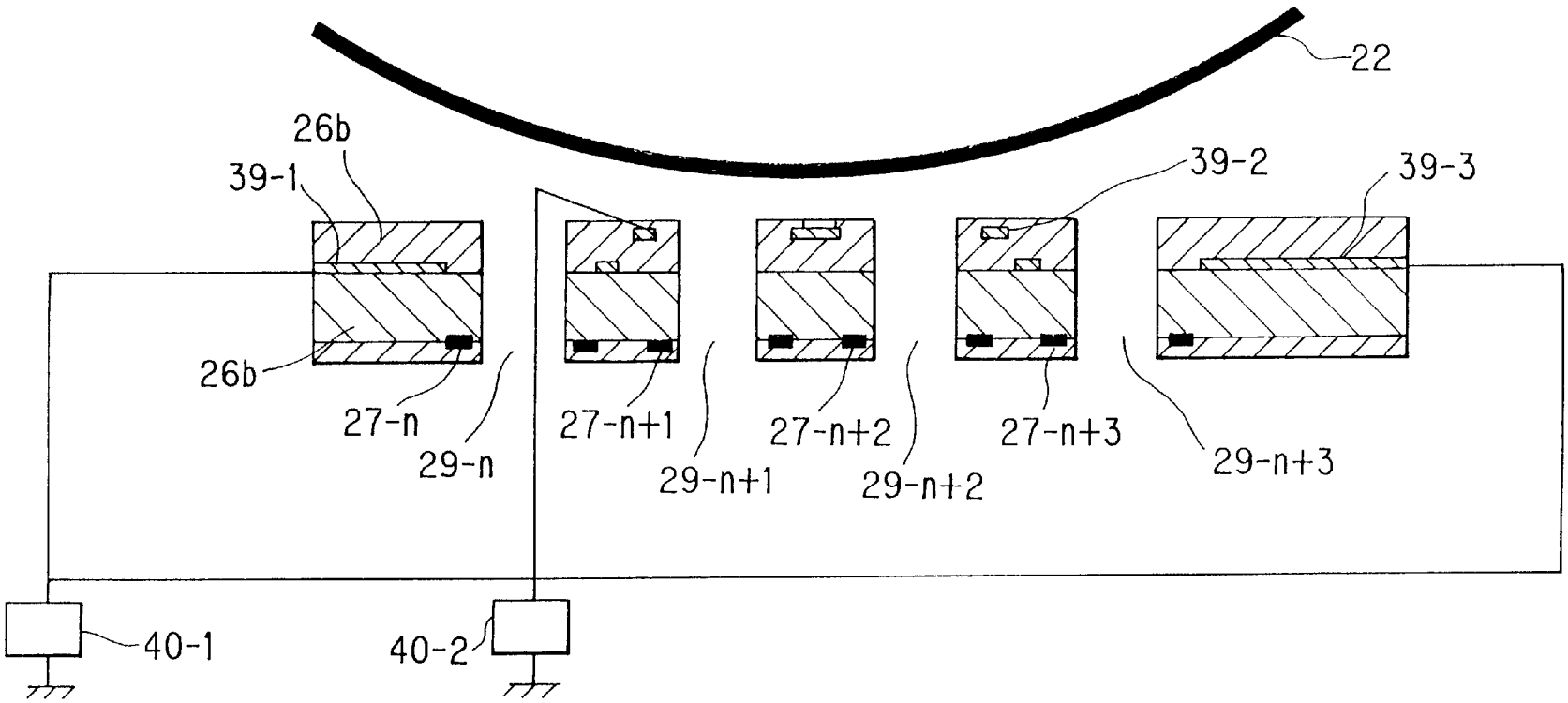
FIG. 25 is a sectional view showing another embodiment of a control electrode in accordance with the present invention.
Figure 26:
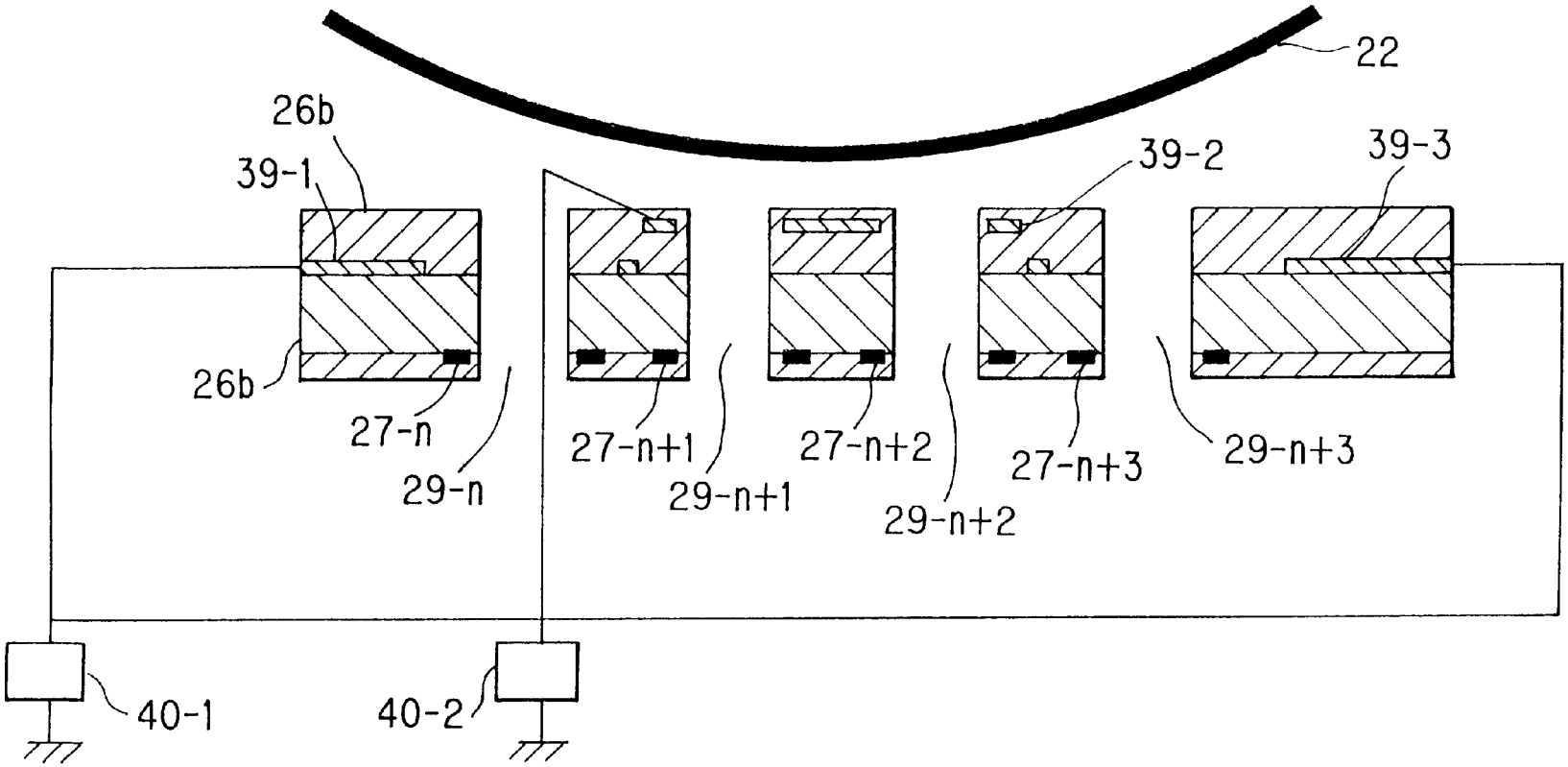
FIG. 26 is a sectional view showing another embodiment of a control electrode in accordance with the present invention.

When the uniformity of toner jumping is still insufficient in the configuration shown in FIG. 23, or if a more fine uniformity is needed, it is effective to vary the size of the openings in shield electrodes 39 and/or adjust the applied voltage, as shown in FIGS. 24, 25 and 26. In FIG. 24, the openings of shield electrode 39 are adapted to be greater in off-center gates 29 and smaller in center gates 29. However, in the configuration shown in FIG. 24, there are cases where the difference in diameter between the opening of shield electrode 39 and the opening of annular electrode 27 is insufficient causing difficulty in the alignment therebetween. In such a case, the voltages applied to individual shield electrodes 39 each having openings of an identical diameter may be differentiated from one another as shown in FIG. 25. In the case of FIG. 25, shield electrodes 39-1 and 39-3 are adapted to have a voltage of −10 V from shield power source 40-1 while shield electrode 39-2 is adapted to have a voltage of −50 V from shield power source 40-2. In this case, the difference in size of the openings can be set relatively large to ensure a large margin for alignment between the openings, thus suppressing reduction of the production yield due to mis-alignment of the openings.

There are cases where a further improved uniformity of toner jumping is needed or where a further fine uniformity is demanded because of the harsh conditions of the usage environment. In such a case, it is possible to realize a more precise and more sufficient uniformity of toner jumping by controlling the positions, the diameter of the openings and the applied voltage of shield electrodes 39.

Figure 27:
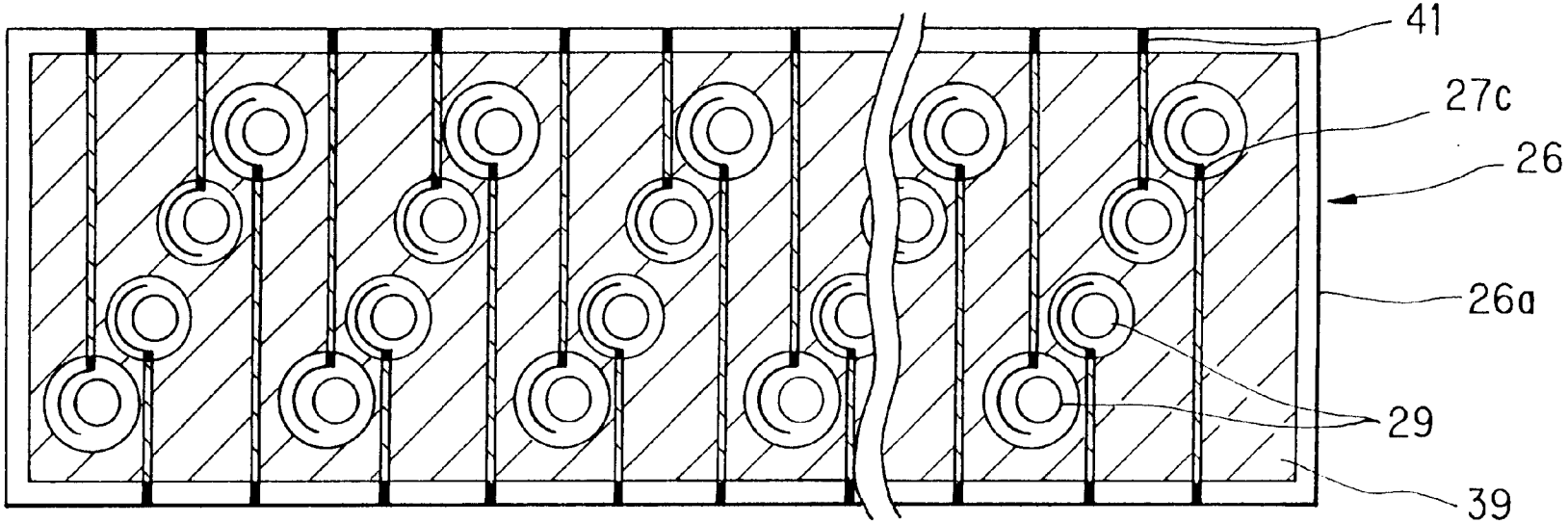
FIG. 27 is a schematic view showing another embodiment of a control electrode in accordance with the present invention.

In the above embodiments, the electrodes formed on control electrode 26 have circular openings, but the shape of the electrodes is not particularly limited as long as it can perform the desired jumping control of toner 21. For example, as shown in FIG. 27, semi-circular electrodes 27*c* having a semi-circular shape may be used. FIG. 27 shows a case where the diameter of the openings in shield electrode 39 is differentiated depending on its distance from toner support 22. Other than this, it is also possible to achieve the same effects as above by applying the specifications of the invention to the openings of shield electrodes 39, the size of semi-circular electrodes 27*c* and the potentials of shield electrodes and thus it is possible to attain excellent image forming.

If the environment in which the image forming apparatus of the above embodiment is used varies, for instance when it is used in a high temperature, high humidity environment, the characteristic values of toner 21, e.g., the amount of static charge, the cohesion of the toner are subject to change and hence the jumping state may change easily, depending upon the toner 21 to be used. To deal with this situation, it is preferable, for example, that a probe for measuring the surface potential of the toner 21 layer (see FIG. 11) is provided upstream of the region facing gates 29 to indirectly measure the amount of static charge and the potential of shield electrode 39 is adjusted based on the measurement so as to achieve excellent jumping of toner 21. This configuration of adjusting the potential of shield electrode 39 needs a more complicated power supplying means but this configuration is more easily realized than the variation of other parameters, so that control of this potential is the most preferable. However, if adjustment of other parameters is easier, these parameters may be controlled for the adjustment.

Figure 28:
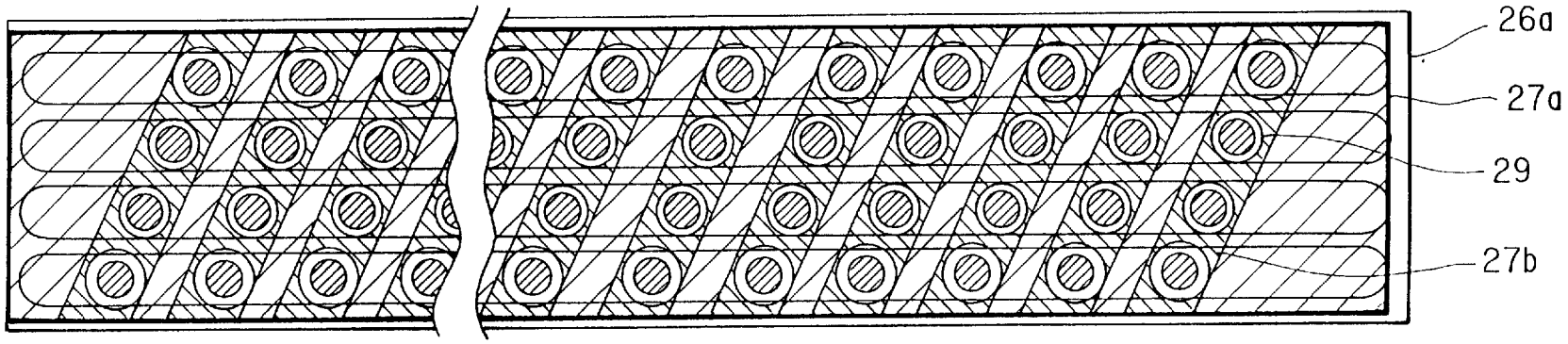
FIG. 28 is a schematic diagram showing a matrix type control electrode.

In the above description of the embodiment, although a single drive control was explained wherein jumping of toner 21 through each gate 29 is controlled by a different electrode, it is also possible to apply the present invention in the same manner to the case where a matrix electrode driven in a matrix drive as shown in FIG. 13 is used, achieving excellent image forming. FIG. 28 shows a case where the diameter of the openings of shield electrode 39 is differentiated depending upon their distance from toner support 22. Other than this, it is also possible to achieve the same effects as above by applying the specifications of the invention to the openings of shield electrodes 39, the size of the openings of strip-like electrodes 27*a* and 27*b* and the potentials of the shield electrodes, and thus it is possible to attain excellent image forming.

(Color Image Forming Apparatus)

Figure 29:
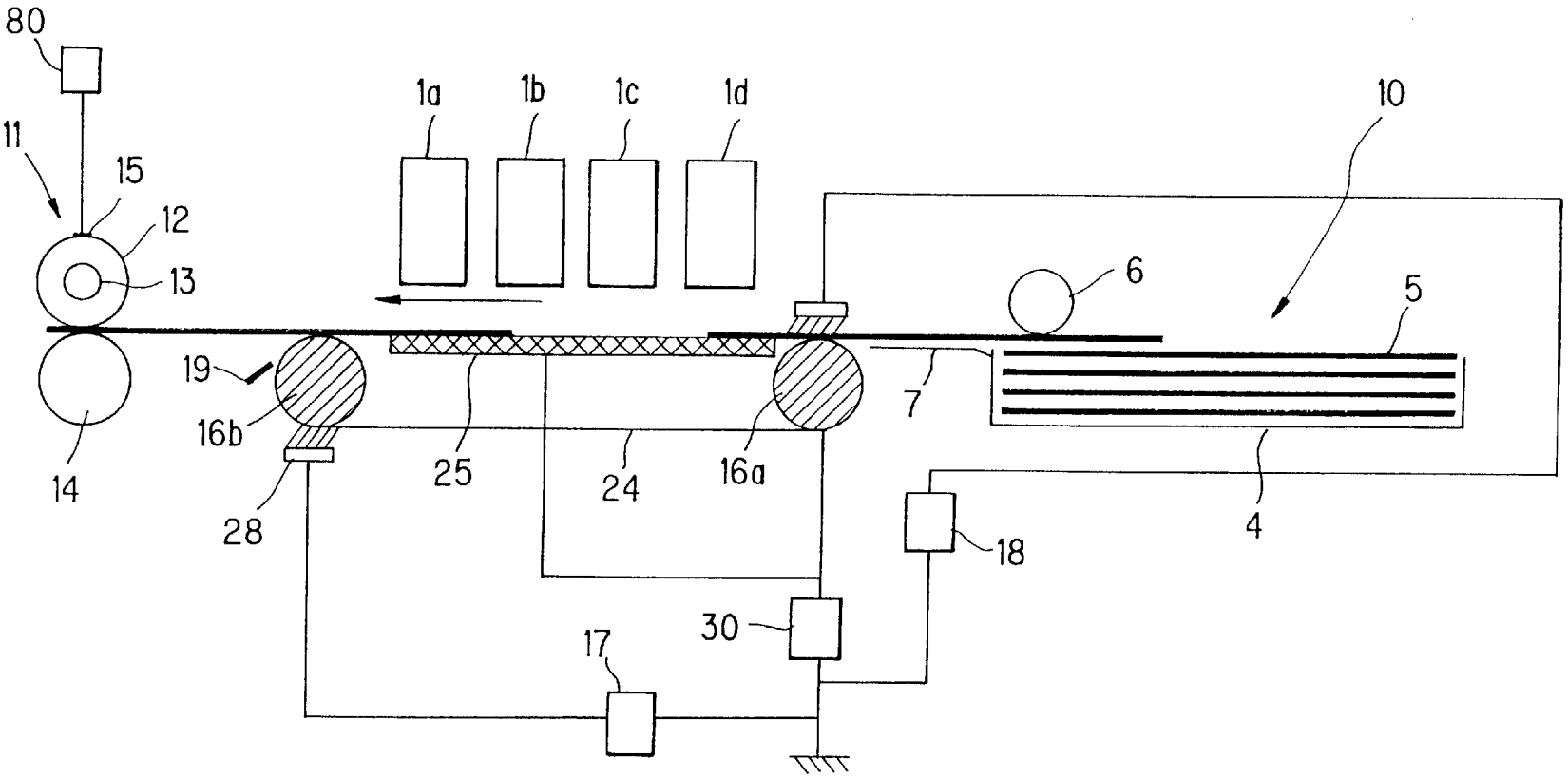
FIG. 29 is a schematic diagram showing a color image forming apparatus in accordance with the present invention.

In the above description of the embodiments, a monochrome image forming apparatus was illustrated. The present invention can also be applied to a color image forming apparatus with an increased effectiveness. For example, a color image forming apparatus may be configured by providing a plurality of image forming units 1*a*, 1*b*, 1*c* and 1*d* made up of toner supplying sections and printing sections wherein toner supplying sections are filled with color toners, e.g., yellow, magenta, cyan and black. In FIG. 29, image forming units 1*a*, 1*b* 1*c* and 1*d* corresponding to yellow, magenta, cyan and black are arranged and color images are formed in accordance with color image data. The other components are the same as those in FIG. 8.

In the case of a color image forming apparatus, if the desired diameter and density of the dots cannot be obtained due to adherence of the toner to the control electrode which makes the desired control of toner jumping difficult or due to deficiencies from the difference in the jumping amount of toner between off-center gates 29 and center gates 29, this detect gives rise to a new problem of disability of correct reproduction of colors. In particular, if there is a color toner 21 which contains a markedly greater amount of oppositely charged toner 21 among the four kinds of toners 21, the developing unit which supports this color toner containing the greater amount of opposite charged toner 21, is liable to receive the above deficiencies. If this happens, it becomes impossible to control the jumping of toner 21 of the color in question, resulting in difficulty to achieve a desired reproduction of colors. In contrast, in accordance with the invention, the above deficiencies will not occur at all, so that it is possible to perform desired reproduction of colors and hence excellent color image forming.

(Other references)

In the description of the embodiment, the example where the toner is used as the developer was explained, but ink etc. can be used as the developer. It is also possible to construct toner supplying section 2 with a structure using an ion flow process. Specifically, the image forming unit may includes an ion source such a corona charger or the like. Also in this case, it is possible to have the same operation and effect as stated above.

The image forming apparatus in accordance with the invention can be preferably applied to the printing unit in digital copiers, facsimile machines as well as to digital printers, plotters, etc.

In accordance with the first configuration, a voltage equal to the surface potential of the toner layer supported on the toner support is applied to the shield electrode, therefore no potential difference and hence no electric filed is generated between the toner layer and shield electrode. Accordingly, regardless of the polarity of the static charge on the toner, no toner will transfer to the shield electrode, and hence no toner will adhere to the shield electrode. Therefore, it is possible to avoid the occurrence of the aforementioned various deficiencies such as gate clog etc., due to buildup of the adhering toner, and hence achieve excellent image forming.

In accordance with the second configuration, the potential to be applied to the toner as the OFF potential is adapted to be a potential which is equal to the surface potential of the toner layer carried on the toner support, therefore no potential difference and hence no electric field will be generated between the toner layer and the gate electrodes of the control electrode. Accordingly, regardless of the polarity of the static charge on the toner, no toner will transfer to the shield electrode, and hence no toner will adhere to the shield electrode. Therefore, it is possible to avoid the occurrence of the aforementioned various deficiencies such as gate clog etc., due to buildup of the adhering toner, and hence achieve excellent image forming.

In accordance with the third configuration, since the surface potential of the toner layer carried on the toner support is measured and the voltage measure is applied to required electrodes of the control electrode, no potential difference and hence no electric field will be generated between the toner layer and the electrodes of the control electrode. Accordingly, regardless of the polarity of the static charge on the toner, no toner will transfer to the shield electrode, and hence no toner will adhere to the shield electrode. Therefore, even when the surface potential of the toner layer easily varies, it is possible to avoid the occurrence of the aforementioned various deficiencies such as gate clog etc., due to buildup of the adhering toner, and hence achieve excellent image forming.

In accordance with the fourth configuration, since the shield electrode and the gate electrodes to which the voltage for controlling toner jumping is applied are arranged on the same plane, the gate electrodes can be placed closer to the toner support, thus making it possible to reduce the control voltage. Accordingly, the withstanding voltage of the potential switching means to be used for this function can be reduced and hence the circuit cost.

In accordance with the fifth configuration, since the degree of exposure (including the degree of electrical exposure) of the gate electrodes to the toner support or the toner carried on the toner support is adjusted by the shield electrode, a desired amount of jumping toner can be obtained easily, thus making it possible to achieve excellent image forming.

In accordance with the sixth configuration, since the aforementioned degree of exposure can be adjusted by the positional relationship or the potential differences of the shield electrode relative to the toner support and the gate electrodes, it is possible to easily vary the size of the toner jumping area and thus achieve excellent image forming, without increasing the cost of the power sources used.

In accordance with the seventh configuration, since the aforementioned degree of exposure of each gate electrode can be adjusted in accordance with the feature of the electrode, the degree of exposure can be adjusted more properly, thus making it possible to maintain excellent image forming.

The eighth configuration is to deal with the case where the distance between the toner support and the control electrode is not uniform. In such a situation, the electric field forming area on the support surface, generated by the electrode to which a voltage is applied in order to control the jumping of toner will vary depending upon its distance to the toner support. In this case, the degree of exposure (including the degree of electrical exposure) of the gate electrodes to the toner support or the toner carried on the toner support is adjusted by the shield electrode so as to obtain a desired or uniform amount of jumping toner for all the gates, thus making it possible to achieve excellent image forming.

In accordance with the ninth configuration, since the ratio between the openings of the gate electrode and shield electrode is manipulated to adjust the degree of exposure of the gate, it becomes possible for all gates to perform a uniform or desired control of jumping toner. Hence excellent image forming can be attained without increase in cost.

In accordance with the tenth through fourteenth configurations, even when the jumping state of toner is liable to change depending upon the environment under which the image forming apparatus is used, the potential and/or the position of the shield electrode can be manipulated in accordance with the change in environment. Accordingly, it is possible to achieve excellent image forming under any environment.

What is claimed is:

1. An image forming apparatus comprising:

a supporting means for supporting a developer;

an opposing electrode disposed facing the supporting means;

a control electrode wherein a plurality of gates which form passage for the developer, a plurality of gate electrodes each located around a gate and a shield electrode having openings which each corresponds to a gate electrode and allow at least part of the gate electrode to be directly or electrically exposed to the supporting means are provided on an insulative board disposed between the supporting means and the opposing electrode; and a controlling means which applies a predetermined voltage to each of the electrodes on the control electrode at least in accordance with the image data, wherein the controlling means controls passage of gates for the developer by applying the predetermined potential to the gate electrodes so as to form an image on a recording medium as the recording medium is being conveyed between the control electrode and the opposing electrode, characterized in that the controlling means applies a voltage at least to the shield electrode, the applied voltage being equal or approximately equal to the surface potential of the developer when the developer is carried on the supporting means, consequently there is no potential difference between the developer on the supporting means and the shield electrode.

2. An image forming apparatus comprising:

a supporting means for supporting a developer;

an opposing electrode disposed facing the supporting means;

a control electrode wherein a plurality of gates which form passage for the developer, a plurality of gate electrodes each located around a gate and a shield electrode having openings which each corresponds to a gate electrode and allow at least part of the gate electrode to be directly or electrically exposed to the supporting means are provided on an insulative board disposed between the supporting means and the opposing electrode;

wherein there is no potential difference between the developer on the supporting means and the shield electrode; and a controlling means which applies a predetermined voltage to each of the electrodes on the control electrode at least in accordance with the image data, wherein the controlling means controls passage of gates for the developer by applying the predetermined potential to the gate electrodes so as to form an image on a recording medium as the recording medium is being conveyed between the control electrode and the opposing electrode, characterized in that as the voltage to be applied to a gate electrode when the developer is prohibited from passing at least through the gate, the controlling means applies a voltage equal or approximately equal to the surface potential of the developer, when the developer is carried on the supporting means, to the gate electrode.

3. An image forming apparatus comprising:

a supporting means for supporting a developer;

an opposing electrode disposed facing the supporting means;

a control electrode wherein a plurality of gates which form passage for the developer, a plurality of gate electrodes each located around a gate and a shield electrode having openings which each corresponds to a gate electrode end allow at least part of the gate electrode to be directly or electrically exposed to the supporting means are provided on an insulative board disposed between the supporting means and the opposing electrode;

wherein there is no potential difference between the developer on the supporting means and the shield electrode; and a controlling means which applies a predetermined voltage to each of the electrodes on the control electrode at least in accordance with the image data, wherein the controlling means controls passage of gates for the developer by applying the predetermined potential to the gate electrodes so as to form an image on a recording medium as the recording medium is being conveyed between the control electrode and the opposing electrode, characterized in that the controlling means further has a detecting means for detecting the surface potential of the developer carried on the supporting means, and can apply the voltage equal to the surface potential of the developer carried on the supporting means, detected by the detecting means, to at least one of the electrodes.

4. An image forming apparatus comprising:

a supporting means for supporting a developer;

an opposing electrode disposed facing the supporting means;

a control electrode wherein a plurality of gates which form passage for the developer, a plurality of gate electrodes each located around a gate and a shield electrode having openings which each corresponds to a gate electrode and allow at least part of the gate electrode to be directly or electrically exposed to the supporting means are provided on an insulative board disposed between the supporting means and the opposing electrode;

wherein there is no potential difference between the developer on the supporting means and the shield electrode; and a controlling means which applies a predetermined voltage to each of the electrodes on the control electrode at least in accordance with the image data, wherein the controlling means controls passage of gates for the developer by applying the predetermined potential to the gate electrodes so as to form an image on a recording medium as the recording medium is being conveyed between the control electrode and the opposing electrode, characterized in that the shield electrode and the gates electrodes provided in the control electrode are arranged on an identical plane thereof, and feeder elements connecting the gate electrodes to the control means are provided on the side opposite to the supporting means with respect to the shield electrode.

5. An image forming apparatus comprising:

a supporting means for supporting a developer;

an opposing electrode disposed facing the supporting means;

a control electrode wherein a plurality of gates which form passage for the developer, a plurality of gate electrodes each located around a gate and a shield electrode having openings which each corresponds to a gate electrode and allow at least part of the gate electrode to be directly or electrically exposed to the supporting means are provided on an insulative board disposed between the supporting means and the opposing electrode;

wherein there is no potential difference between the developer on the supporting means and the shield electrode; and a controlling means which applies a predetermined voltage to each of the electrodes on the control electrode at least in accordance with the image data, wherein the controlling means controls passage of gates for the developer by applying the predetermined potential to the gate electrodes so as to form an image on a recording medium as the recording medium is being conveyed between the control electrode and the opposing electrode, characterized in that the degree of exposure including electrical exposure of each gate electrode to the developer carried on the supporting means is controlled by the shield electrode.

6. The image forming apparatus according to claim 5, wherein the degree of exposure is controlled by a positional relationship, and/or a relative potential difference, of the shield electrode relative to supporting means and the gate electrode.

7. The image forming apparatus according to claim 6, further comprising a detecting means for detecting characteristics of the developer or a characteristic value of the developer when the developer is supported on the supporting means, wherein the controlling means controls the degree of exposure based on a detected value of the detecting means.

8. The image forming apparatus according to claim 5, wherein the degree of exposure is adapted to vary for each of the gate electrodes.

9. The image forming apparatus according to claim 8, wherein the variation of the degree of exposure is controlled by the distance between the gate and the developer or depending upon a strength of the electric field formed by the control electrode.

10. The image forming apparatus according to claim 9, further comprising a detecting means for detecting characteristics of the developer or a characteristic value of the developer when the developer is supported on the supporting means, wherein the controlling means controls the degree of exposure based on a detected value of the detecting means.

11. The image forming apparatus according to claim 8, wherein the variation of the degree of exposure is controlled by a ratio between a size of the gate electrode and a diameter of the opening formed in the shield electrode.

12. The image forming apparatus according to claim 11, further comprising a detecting means for detecting characteristics of the developer or a characteristic value of the developer when the developer is supported on the supporting means, wherein the controlling means controls the degree of exposure based on a detected value of the detecting means.

13. The image forming apparatus according to claim 8, further comprising a detecting means for detecting characteristics of the developer or a characteristic value of the developer when the developer is supported on the supporting means, wherein the controlling means controls the degree of exposure based on a detected value of the detecting means.

14. The image forming apparatus according to claim 5, further comprising a detecting means for detecting characteristics of the developer or a characteristic value of the developer when the developer is supported on the supporting means, wherein the controlling means controls the degree of exposure based on a detected value of the detecting means.

* * * * *